US009174427B2

(12) United States Patent
Yamazaki

(10) Patent No.: US 9,174,427 B2
(45) Date of Patent: Nov. 3, 2015

(54) PRINTING RELIEF PLATE, PRINTING RELIEF PLATE PRODUCING APPARATUS, PRINTING APPARATUS, PRINTING PRESSURE DETERMINING APPARATUS, AND METHODS THEREFOR

(71) Applicant: FUJIFILM Corporation, Tokyo (JP)

(72) Inventor: Yoshirou Yamazaki, Kanagawa-ken (JP)

(73) Assignee: FUJIFILM CORPORATION, Tokyo (JP)

( * ) Notice: Subject to any disclaimer, the term of this patent is extended or adjusted under 35 U.S.C. 154(b) by 42 days.

(21) Appl. No.: 14/034,768

(22) Filed: Sep. 24, 2013

(65) Prior Publication Data

US 2014/0090569 A1 Apr. 3, 2014

(30) Foreign Application Priority Data

Sep. 28, 2012 (JP) ..... 2012-217070
Sep. 28, 2012 (JP) ..... 2012-217076

(51) Int. Cl.

| | |
|---|---|
| ***B41N 1/12*** | (2006.01) |
| ***B41F 3/54*** | (2006.01) |
| ***B41N 1/06*** | (2006.01) |
| *B41F 33/00* | (2006.01) |
| *B41C 1/05* | (2006.01) |

(52) U.S. Cl.

CPC ... *B41F 3/54* (2013.01); *B41N 1/06* (2013.01); *B41C 1/05* (2013.01); *B41F 33/0036* (2013.01); *B41F 33/0072* (2013.01); *B41N 1/12* (2013.01)

(58) Field of Classification Search

CPC ..... B41F 33/00
See application file for complete search history.

(56) References Cited

U.S. PATENT DOCUMENTS

| | | | | |
|---|---|---|---|---|
| 6,158,345 | A * | 12/2000 | Gelbart | 101/485 |
| 2005/0157347 | A1* | 7/2005 | Dewitte | 358/3.3 |
| 2007/0047030 | A1* | 3/2007 | Schonert et al. | 358/504 |
| 2008/0314277 | A1 | 12/2008 | Kusaka et al. | |

(Continued)

FOREIGN PATENT DOCUMENTS

| | | | |
|---|---|---|---|
| JP | 02-009635 | A | 1/1990 |
| JP | 04-221640 | A | 8/1992 |
| JP | 2002-137558 | A | 5/2002 |

(Continued)

OTHER PUBLICATIONS

Japanese Office Action dated Sep. 2, 2014 with an English translation thereof.

(Continued)

*Primary Examiner* — Jill Culler
(74) *Attorney, Agent, or Firm* — McGinn IP Law Group PLLC

(57) ABSTRACT

On a printing relief plate, which is produced by a printing relief plate producing apparatus and a printing relief plate producing method, convexities and detecting portions are set to be lower than a solid area of the printing relief plate. In the event that a detecting portion image and a solid area image are printed on a print medium using the printing relief plate by a printing apparatus and by carrying out a printing method, in a printing pressure determining apparatus and a printing pressure determining method, it is determined whether a printing pressure is an appropriate printing pressure or not by comparing an optical density of the detecting portion image and an optical density of the solid area image.

18 Claims, 15 Drawing Sheets

(56) References Cited

U.S. PATENT DOCUMENTS

| | | | |
|---|---|---|---|
| 2011/0252990 | A1 | 10/2011 | Shimazaki et al. |
| 2011/0255134 | A1 | 10/2011 | Shigeta et al. |

FOREIGN PATENT DOCUMENTS

| | | | |
|---|---|---|---|
| JP | 2009-881 | A | 1/2009 |
| JP | 2010-214944 | A | 9/2010 |
| JP | 2011-088353 | A | 5/2011 |
| JP | 2011-224878 | A | 11/2011 |
| JP | 2011-227304 | A | 11/2011 |
| JP | 4962855 | B2 | 6/2012 |

OTHER PUBLICATIONS

Extended European Search Report dated Jul. 30, 2015.

* cited by examiner

PRINTING RELIEF PLATE, PRINTING RELIEF PLATE PRODUCING APPARATUS, PRINTING APPARATUS, PRINTING PRESSURE DETERMINING APPARATUS, AND METHODS THEREFOR

CROSS-REFERENCE TO RELATED APPLICATIONS

This application is based upon and claims the benefit of priority from Japanese Patent Applications No. 2012-217070 filed on Sep. 28, 2012, and No. 2012-217076 filed on Sep. 28, 2012, the contents all of which are incorporated herein by reference.

BACKGROUND OF THE INVENTION

1. Field of the Invention

The present invention relates to a printing relief plate provided on the surface of a plate material, and on which convexities are formed for transferring inks to a print medium to print halftone dots thereon. Further, the present invention relates to a printing relief plate producing apparatus and a printing relief plate producing method for producing the aforementioned printing relief plate. Furthermore, the present invention also relates to a printing apparatus and a printing method for transferring inks from the printing relief plate to a print medium to print halftone dots thereon. Still further, the present invention relates to a printing pressure determining apparatus and a printing pressure determining method for determining whether or not a printing pressure applied to a printing relief plate is an appropriate printing pressure in a case where ink is transferred to a print medium from the printing relief plate.

2. Description of the Related Art

For example, in flexographic printing, a printing relief plate, which is made from a flexible plate material having elasticity, is mounted on the surface of a plate cylinder. Convexities for printing halftone dots by transferring ink to a print medium are formed on a surface (plate surface) of the printing relief plate. Then, in the case that ink is supplied to a plate surface from an anilox roller, under a condition in which the print medium is gripped by the plate cylinder and an impression cylinder, the ink is transferred to the print medium from the plate surface, and halftone dots can be printed on the print medium. Consequently, a desired image can be transferred to (printed on) the print medium.

In this case, by adjusting the pressure (anilox pressure) between the anilox roller and the plate surface, and the pressure (printing pressure) between the plate surface and the print medium, printing conditions for the print medium can be determined. Further, for satisfactorily transferring the entire image (image pattern) to the print medium, preferably, the printing pressure is kept as low as possible (at a minimum printing pressure necessary for favorably transferring the entire image).

Japanese Patent No. 4962855 discloses a technique wherein a detecting portion, which is lower than an image printing area made up of convexities, is formed on a plate surface, and in the case that ink from the detecting portion is transferred to the print medium, it is determined that an excessive printing pressure (also referred to below as an over-printing pressure) is applied onto a plate surface.

Further, Japanese Laid-Open Patent Publication No. 02-009635 and Japanese Laid-Open Patent Publication No. 2009-000881 disclose techniques for adjusting a printing pressure, based on a line width or density of a linear portion, which is printed on a print medium.

Furthermore, Japanese Laid-Open Patent Publication No. 2002-137558 discloses a technique of inspecting the quality of a printing relief plate, by confirming an image that is transferred to a print medium by transfer of ink to the print medium from quality-confirming convexities that are formed on the plate surface.

SUMMARY OF THE INVENTION

The technique disclosed in Japanese Patent No. 4962855 is premised on the concept of supplying ink to a detecting portion. On the other hand, concerning transfer of ink to the plate surface from the anilox roller, the only required condition is that an anilox pressure be provided so as to supply ink to lowest portions of the image printing area (i.e., to lowest convexities in the case that plural convexities are formed). For this reason, it is not necessarily the case that ink can always be supplied to the detecting portion, which is lower than the image printing area.

Accordingly, with the technique of Japanese Patent No. 4962855, under a condition in which ink is not supplied to the detecting portion, if the print medium is gripped between a plate cylinder and an impression cylinder, and ink applied to the plate surface is transferred to the print medium, ink cannot be transferred from the detecting portion to the print medium. Consequently, even if an over-printing pressure exists, a problem occurs in that a mistaken judgment is made that printing has been carried out at an optimal printing pressure (hereinafter referred to as an appropriate printing pressure) with respect to the print medium. Further, no suitable technique for overcoming the aforementioned problems is disclosed in any of Japanese Laid-Open Patent Publication No. 02-009635, Japanese Laid-Open Patent Publication No. 2009-000881, and Japanese Laid-Open Patent Publication No. 2002-137558.

The present invention has been conceived of taking into consideration the aforementioned problems, and an object of the present invention is to provide a printing relief plate, which is capable of determining easily, without regard to anilox pressure conditions, whether a printing pressure is an appropriate printing pressure or an excessive printing pressure. Further, an object of the present invention is to provide a printing relief plate producing apparatus and a printing relief plate producing method, which can produce a printing relief plate having the above features. Furthermore, an object of the present invention is to provide a printing apparatus and a printing method, which can carry out printing on a print medium using the aforementioned printing relief plate. Still further, an object of the present invention is to provide a printing pressure determining apparatus and a printing pressure determining method, which are capable of determining easily whether a printing pressure is an appropriate printing pressure or an excessive printing pressure, based on an image which is printed on a print medium using the aforementioned printing relief plate.

The present invention relates to a printing relief plate having convexities formed on a surface of a plate material, the convexities being adapted to print halftone dots on a print medium by transferring ink to the print medium.

For achieving the aforementioned objects, a printing relief plate according to the present invention includes the following structure.

More specifically, on the surface of the plate material, there are provided a solid area, an image forming region in which the convexities are formed in plurality, and at least one detecting portion for determining a magnitude of a printing pressure applied to the printing relief plate in a case where ink is transferred to the print medium from the printing relief plate. The convexities and the detecting portion are positioned lower than the solid area.

Further, it can be determined whether the printing pressure is an appropriate printing pressure or not by comparing a density of at least one detecting portion image, which is printed on the print medium by transferring ink to the print medium from the detecting portion, with a density of a solid area image, which is printed on the print medium by transferring ink to the print medium from the solid area.

In this case, the printing relief plate according to the present invention includes the following first characteristic or second characteristic, as described below.

More specifically, according to the first characteristic of the present invention, the detecting portion and a lowest highlight convexity among the convexities are set at substantially the same height.

According to the first characteristic, the lowest convexity (i.e., the highlight convexity) and the detecting portion are set at substantially equal heights. For this reason, for example, even if the anilox pressure is set to a minimum pressure suitable for the printing conditions of the print medium, ink can be supplied to both the highlight convexity and the detecting portion, which are of substantially the same height. Consequently, ink applied to the detecting portion can reliably be transferred to the print medium, whereby printing of the detecting portion image can be assured. Accordingly, by comparing the density of the detecting portion image with the density of the solid area image, irrespective of the magnitude of the anilox pressure, it can be easily determined whether the printing pressure is either an appropriate printing pressure or an excessive printing pressure.

The aforementioned first characteristic of the invention preferably includes the following additional structures.

More specifically, preferably, if the density of the detecting portion image is lower than the density of the solid area image, it may be determined that the printing pressure is an appropriate printing pressure, whereas if the density of the detecting portion image is substantially equivalent to the density of the solid area image, it may be determined that the printing pressure is an excessive printing pressure.

On the printing relief plate, the solid area is a substantially flat portion having an area equal to or greater than a certain fixed area, which is positioned higher than other portions making up the printing relief plate.

For this reason, in the case that the printing pressure is an appropriate printing pressure, the plate surface of the printing relief plate is in a kiss-touch state with respect to the print medium, whereby ink is transferred securely to the print medium from the solid area, together with ink being transferred to the print medium from the detecting portion in a lightly touching manner. In this case, the density of the solid area image is substantially 100% (i.e., density corresponding to an image completely filled with ink and free of halftone dots), whereas the density of the detecting portion image is of a sufficiently low density compared to the solid area image.

On the other hand, if the printing pressure is an excessive printing pressure, ink also is securely transferred to the print medium from the detecting portion, and therefore the density of the detecting portion image becomes substantially equivalent to the density of the solid area image.

Thus, according to the first characteristic, as described above, by comparing the density of the detecting portion image with the density of the solid area image, it can be determined easily whether or not the printing pressure is an excessive printing pressure.

Further, preferably, the detecting portion is a recess formed in the solid area, wherein a height position of a bottom surface of the recess is substantially the same as a height position of an apex of the highlight convexity. Owing thereto, ink supplied from the anilox roller is accommodated in the recess, and the ink which is accommodated therein can be transferred reliably to the print medium.

Furthermore, if at least the apex of the highlight convexity is formed as a flat portion, the quality of the image (halftone dots) formed by ink that is transferred to the print medium from the highlight convexity can be improved.

Further, each of the aforementioned effects can be obtained easily if the detecting portion is placed at the same height position as the highlight convexity, or is placed at a slightly higher height position than the highlight convexity. Furthermore, it goes without saying that the aforementioned effects can also be obtained even in the case that the convexities are set at positions of the same height as the highlight convexity.

Furthermore, a plurality of the detecting portions may be formed on the surface of the plate material, and a plurality of the detecting portion images may be printed on the print medium by transferring ink to the print medium from each of the detecting portions. In this case, it may be determined whether the printing pressure is an appropriate printing pressure or an excessive printing pressure, by comparing a density of the solid area image and a density of each of the detecting portion images and then making a majority decision between the number of detecting portion images corresponding to the appropriate printing pressure and the number of detecting portion images corresponding to the excessive printing pressure.

With the printing relief plate, cases may occur in which a height variance (height distribution) exists to some degree over the entirety of the printing relief plate. Thus, a plurality of detecting portions are provided, and by a majority decision based on the comparison result between the density of the solid area image and a density of each of the detecting portion images corresponding to the respective detecting portions, it can be determined whether the printing pressure is an appropriate printing pressure or an excessive printing pressure. In this manner, the influence of any height variance of the respective detecting portions on the judgment result of the printing pressure can be suppressed, and a determination can be carried out reliably and accurately as to whether the printing pressure is an appropriate printing pressure or an excessive printing pressure.

On the other hand, with the second characteristic according to the present invention, on the surface of the plate material, there are provided the solid area, the image forming region, and a plurality of the detecting portions. In this case, the detecting portions are of mutually different widths, and are positioned higher than a lowest highlight convexity among the convexities, or are of the same height as the highlight convexity.

In addition, it can be determined whether the printing pressure is an appropriate printing pressure or not by comparing densities of a plurality of the detecting portion images, which are printed on the print medium by transferring ink to the print medium from the detecting portions, with a density of the solid area image.

In the manner, in accordance with the second characteristic, the detecting portions are set at a position higher than the lowest convexity (i.e., the aforementioned highlight convexity), or are of the same height as the highlight convexity. Thus, even if the anilox pressure is set to a minimum pressure suitable for the printing conditions of the print medium, ink can be supplied to both the highlight convexity and to each of the detecting portions. Consequently, ink applied to the detecting portions can reliably be transferred to the print medium, whereby printing of the detecting portion images can be assured.

Further, if the respective detecting portions are of mutually different widths, even if the same printing pressure is applied to each of the detecting portions, the attachments of ink that is transferred to the print medium from each of the detecting portions differ from one another, with the result that the widths of the detecting portion images corresponding to the respective detecting portions differ mutually from each other. More specifically, as the widths of the detecting portions become wider, ink is transferred more easily to the print medium, and the density of the detecting portion images corresponding to such detecting portions approaches more closely to the density of the solid area image.

Thus, according to the second characteristic, by comparing the density of each of the detecting portion images of mutually different widths with the density of the solid area image, irrespective of the magnitude of the anilox pressure, it can easily be determined whether the printing pressure is either an appropriate printing pressure or an excessive printing pressure.

The aforementioned second characteristic of the invention preferably includes the following additional structures.

More specifically, preferably, if the densities of the detecting portion images are lower than the density of the solid area image, even if ink is transferred to the print medium from the detecting portions, it is determined that the printing pressure is an appropriate printing pressure, whereas among the detecting portion images, if there is at least one detecting portion image that has substantially the same density as the density of the solid area image, it is determined that the printing pressure is an excessive printing pressure.

On the printing relief plate, the solid area is a substantially flat portion having an area equal to or greater than a certain fixed area, which is formed at a position higher than other portions making up the printing relief plate.

For this reason, in the case that the printing pressure is an appropriate printing pressure, the plate surface of the printing relief plate is in a kiss-touch state with respect to the print medium, whereby ink is transferred securely to the print medium from the solid area, together with ink being transferred to the print medium from each of the detecting portions in a lightly touching manner. In this case, the density of the solid area image is substantially 100% (i.e., density corresponding to an image completely filled with ink and free of halftone dots), whereas the densities of the detecting portion images are of a low density compared to the solid area image, even though the widths of the detecting portions differ from one another.

On the other hand, if the printing pressure is an excessive printing pressure, since as the widths of the detecting portions become wider, ink is more easily transferred to the print medium, ink from at least one of the detecting portions is transferred securely to the print medium, and the density of the detecting portion image corresponding to the concerned detecting portion becomes substantially equivalent to the density of the solid area image.

Thus, according to the second characteristic, as described above, by comparing the densities of the respective detecting portion images with the density of the solid area image, it can be determined easily and reliably whether or not the printing pressure is an excessive printing pressure.

Further, as noted above, as the width of the detecting portions becomes wider, it is easier for ink to be transferred to the print medium, and therefore, among the detecting portion images, if the density of a detecting portion image corresponding to a comparatively wide detecting portion is substantially equal to the density of the solid area image, the printing pressure can easily be judged as being an excessive printing pressure.

Further, since the attachments of ink transferred to the print medium from the respective detecting portions differ mutually from each other due to differences in the widths of the detecting portions, it may be determined whether the printing pressure is an appropriate printing pressure or not, based on a density difference between two of the detecting portion images that correspond to at least two detecting portions of mutually different widths. For example, it may be determined whether the printing pressure is an appropriate printing pressure or an excessive printing pressure, based on a relative density difference between the density of a detecting portion image corresponding to a comparatively wide detecting portion and the density of a detecting portion image corresponding to a comparatively narrow detecting portion.

Furthermore, the detecting portions may be recesses formed in the solid area, and height positions of bottom surfaces of the recesses may be higher than a height position of an apex of the highlight convexity, or are substantially the same as the height position of the apex. Owing thereto, ink supplied from the anilox roller is accommodated in the respective recesses, and the ink which is accommodated therein can be transferred reliably to the print medium.

Further, in the case that at least two of the detecting portions of different widths are regarded as one detecting portion unit, a plurality of the detecting portion units may be formed on the surface of the plate material. In this case, a plurality of the detecting portion images can be printed on the print medium by transferring ink to the print medium from each of the detecting portions of the detecting portion units. Additionally, it may be determined whether the printing pressure is an appropriate printing pressure or an excessive printing pressure, by comparing a density of the solid area image with a density of each of the detecting portion images and then making a majority decision between the number of detecting portion images corresponding to the appropriate printing pressure and the number of detecting portion images corresponding to the excessive printing pressure.

With the printing relief plate, cases may occur in which a height variance (height distribution) exists to some degree over the entirety of the printing relief plate. Thus, a plurality of the detecting portion units are provided, and by a majority decision based on the comparison result between the density of the solid area image and the density of each of the detecting portion images corresponding to the respective detecting portions, it can be determined whether the printing pressure is an appropriate printing pressure or an excessive printing pressure. In this manner, the influence of any height variance of the detecting portions on the judgment result of the printing pressure can be suppressed, and a determination can be carried out reliably and accurately as to whether the printing pressure is an appropriate printing pressure or an excessive printing pressure.

In addition, for producing the printing relief plate according to the present invention, a printing relief plate producing apparatus and a printing relief plate producing method may be providing having the following structure and method steps.

More specifically, the printing relief plate producing apparatus according to the present invention is an apparatus for producing a printing relief plate, and comprises a binary image data generator for generating binary image data based on multi-valued image data representative of a printed image, a plate shape determining unit for generating shape data based on the binary image data, the shape data representing shapes of the solid area, the image forming region including the convexities, and the detecting portion, and a printing relief plate producing unit for producing the printing relief plate based on the shape data.

Further, the printing relief plate producing method according to the present invention is a method for producing a printing relief plate, and comprises a step of generating binary image data based on multi-valued image data representative of a printed image, a step of generating shape data based on the binary image data, the shape data representing shapes of the solid area, the image forming region including the convexities, and the detecting portion, and a step of producing the printing relief plate based on the shape data.

On the other hand, a printing apparatus and a printing method may be provided for carrying out printing with respect to the print medium using the printing relief plate according to the present invention, the apparatus and method having the following structure and method steps.

More specifically, the printing apparatus according to the present invention is an apparatus for printing halftone dots on the print medium using the printing relief plate, and comprises an anilox roller, a plate cylinder on which the printing relief plate is mounted, whereby ink is transferred to the printing relief plate from the anilox roller, and an impression cylinder, which sandwiches the print medium in cooperation with the plate cylinder on which the printing relief plate is mounted, whereby ink is transferred to the print medium from the convexities, and then the halftone dots are printed on the print medium.

Further, the printing method according to the present invention is a method for printing halftone dots on the print medium using the printing relief plate, and comprises a step of transferring ink from the anilox roller to the printing relief plate, which is mounted on a plate cylinder, and a step of printing the halftone dots on the print medium by transferring ink to the print medium from the convexities, under a condition in which the print medium is sandwiched between an impression cylinder and the plate cylinder on which the printing relief plate is mounted.

In addition, based on the solid area image and the detecting portion image which are printed on the print medium using the printing relief plate according to the present invention, for determining whether the printing pressure is an appropriate printing pressure or an excessive printing pressure, a printing pressure determining apparatus and a printing pressure determining method may be provided having the following structure and method steps.

More specifically, the printing pressure determining apparatus according to the present invention is an apparatus for determining a magnitude of the printing pressure applied to the printing relief plate in a case where halftone dots are printed on the print medium, and comprises an image capturing device for capturing at least one detecting portion image, and a judgment processor for determining whether a printing pressure is an appropriate printing pressure or not, based on a comparison between a density of the detecting portion image, which is captured by the image capturing device, and a density of a solid area image.

Further, the printing pressure determining method according to the present invention is a method for determining a magnitude of the printing pressure applied to the printing relief plate in a case where halftone dots are printed on the print medium, and comprises a step of capturing at least one detecting portion image, and a step of determining whether a printing pressure is an appropriate printing pressure or not, based on a comparison between a density of the captured detecting portion image, and a density of a solid area image.

Since the aforementioned printing relief plate producing apparatus, the printing relief plate producing method, the printing apparatus, the printing method, the printing pressure determining apparatus, and the printing pressure determining method are a method or apparatus related to the printing relief plate of the present invention, the advantages and effects of the printing relief plate according to the present invention can be also achieved.

Moreover, in the foregoing descriptions, cases have been described in which it is automatically determined, by means of the printing pressure determining apparatus and the printing pressure determining method, whether the printing pressure is either an appropriate printing pressure or an excessive printing pressure. However, with the present invention, as described above, whether the printing pressure is an appropriate printing pressure or an excessive printing pressure is judged based on a comparison between the density of the detecting portion image and the density of the solid area image. For this reason, it also is possible for an operator, by visual observation, to compare the density of the detecting portion image and the density of the solid area image, and to thereby determine whether the printing pressure is either an appropriate printing pressure or an excessive printing pressure.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Preferred embodiments (first embodiment, second embodiment) of the present invention will be described in detail below with reference to the accompanying drawings.

[Description of Printing Relief Plate Producing Apparatus and Printing Relief Plate Producing Method According to the First Embodiment]

Figure 1:
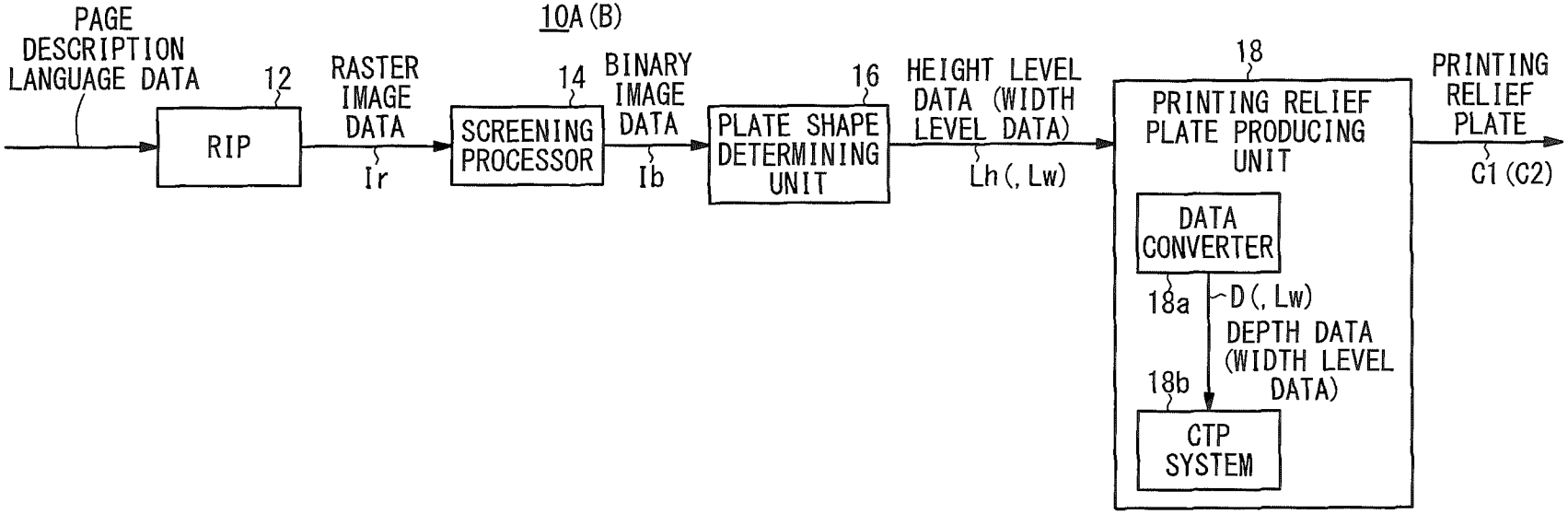
FIG. 1 is a schematic block diagram of a printing relief plate producing apparatus for producing a printing relief plate according to first and second embodiments of the present invention.

As shown in FIG. 1, a printing relief plate producing apparatus 10A according to a first embodiment of the present invention is composed basically of an RIP (Raster Image Processor) 12, a screening processor (binary image data generator 14), a plate shape determining unit 16, and a printing relief plate producing unit 18.

The RIP processor 12 develops PDL (Page Description Language) data, such as PDF (Portable Document Format) data, PS (PostScript: registered trademark) data, or the like, which represent vector images of printed manuscripts edited using a computer or the like, into raster image data Ir.

The screening processor 14 performs a screening process (step of generating binary image data) on the raster image data Ir, under conditions including a predetermined screen (an AM (Amplitude Modulation) screen or an FM (Frequency Modulation) screen, and screen dot shapes), a screen angle, a screen ruling, etc., thereby converting the raster image data Ir into binary image data Ib.

In order to produce a later-described printing relief plate C1 according to the first embodiment by processing the surface of a flexographic printing plate material (an elastic material such as synthetic resin, rubber, or the like) into a desired shape corresponding to the vector image, the plate shape determining unit 16 converts the binary image data Ib into height level data Lh corresponding to the desired shape (step of generating shape data). More specifically, the height level data Lh is shape data indicative of height positions of convexities or the like, which are formed on the surface (printing surface) of the printing relief plate C1.

The printing relief plate producing unit 18 comprises a data converter 18*a*, and an engraving CTP (Computer to Plate) system 18*b*. The data converter 18*a* converts the height level data Lh into depth data D indicative of distances in a depthwise direction of the flexographic printing plate material. The engraving CTP system 18*b* performs a laser engraving process on the flexographic printing plate material based on the depth data D, for thereby producing the printing relief plate C1 on which a plurality of convexities or the like are formed (step of producing the printing relief plate).

[Description of Printing Apparatus and Printing Method According to the First Embodiment]

Figure 2:
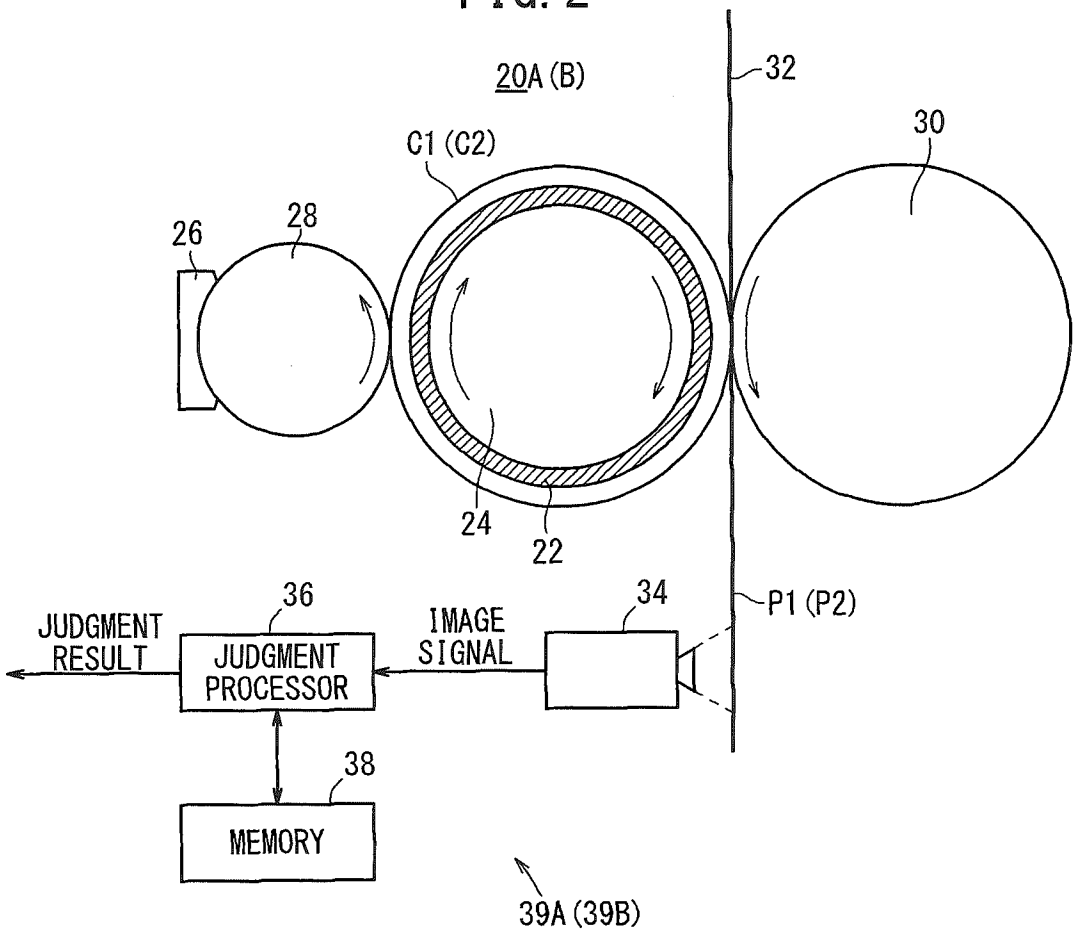
FIG. 2 is a schematic structural view showing a flexographic printing press for carrying out printing with respect to a print medium using a printing relief plate, which is produced by the printing relief plate producing apparatus of FIG. 1, and a printing pressure determining apparatus for determining the magnitude of a printing pressure of the printing relief plate.

FIG. 2 shows basic structural details of a flexographic printing press 20A. As shown in FIG. 2, the flexographic printing press 20A comprises a printing relief plate (flexographic printing plate) C1 produced in the above-described manner, a plate cylinder 24 on which the printing relief plate C1 is mounted via a cushion tape 22 such as a double-sided adhesive tape or the like, an anilox roller 28, which is supplied with ink from a doctor chamber 26, and an impression cylinder 30.

If ink is transferred from the anilox roller 28 onto convexities or the like, which are formed on the surface (plate surface) of the printing relief plate C1 (step of transferring ink to the printing relief plate), the ink applied to the convexities is transferred to a print medium 32 such as a corrugated cardboard material or the like, which is gripped and fed between the plate cylinder 24 on which the printing relief plate C1 is mounted and the impression cylinder 30, thereby producing a desired print P1 on which various images made up of halftone dots are formed on the print medium 32 (step of printing halftone dots).

The basic structure of the printing relief plate producing apparatus 10A and the flexographic printing press 20A is disclosed, for example, in Japanese Laid-Open Patent Publication No. 2011-224878 and Japanese Laid-Open Patent Publication No. 2011-227304, and thus, in the present specification, detailed description thereof is omitted.

[Description of Printing Pressure Determining Apparatus According to the First Embodiment]

On a downstream side (downwardly in FIG. 2) in the direction of conveyance of the print P1 (print medium 32 after printing thereof), a printing pressure determining apparatus 39A is provided, which is made up from an image capturing device 34, a judgment processor 36, and a memory 38.

The image capturing device 34 is a camera, which captures an image that is printed on the print P1. An image signal representing the captured image is output to the judgment processor 36.

The judgment processor 36 detects the optical density of a predetermined portion within the image that is represented by the image signal. In this case, in the memory 38, a table is stored indicative of a relationship between an optical density of the predetermined portion and the printing pressure applied to the plate surface of the printing relief plate C1 during printing thereof. The judgment processor 36, by referring to the table stored in the memory 38, identifies (estimates) the printing pressure corresponding to the detected optical density. In addition, if the identified printing pressure is less than a predetermined printing pressure threshold, the judgment processor 36 determines that the print P1 has been printed at an optimum printing pressure (appropriate printing pressure), whereas if the identified printing pressure is equal to or greater than the predetermined printing pressure threshold, the judgment processor 36 determines that the print P1 has been printed at an excessive printing pressure (over-printing pressure). The judgment result determined by the judgment processor 36 is notified to the exterior.

Details concerning operations of the printing pressure determining apparatus 39A (printing pressure determining method) will be described later.

[Description of Printing Relief Plate According to the First Embodiment]

Figure 3:
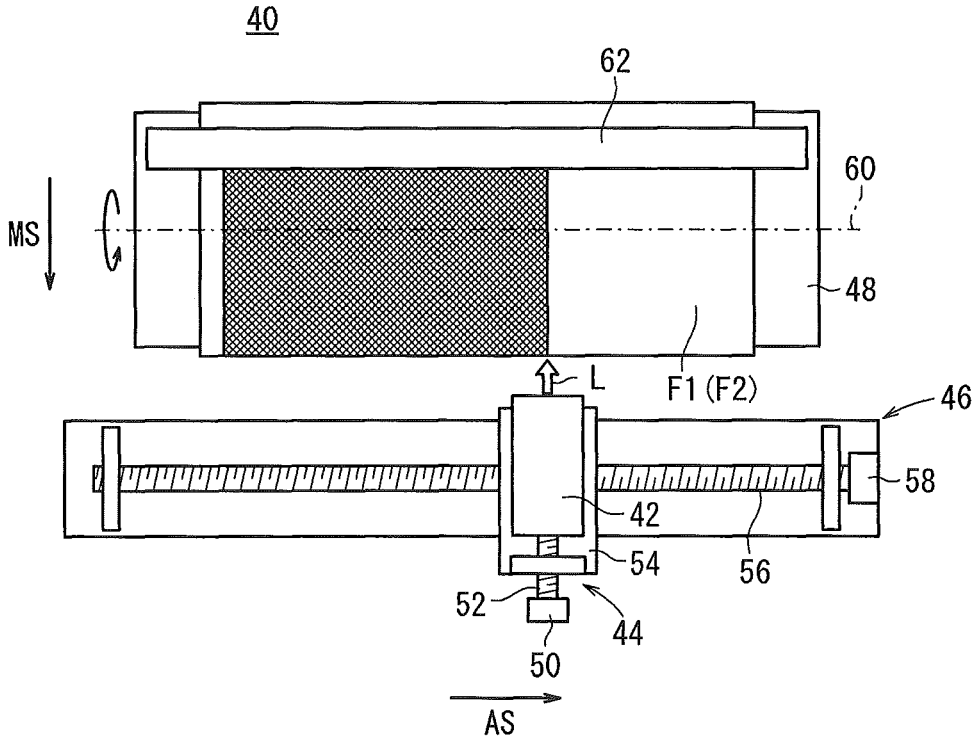
FIG. 3 is a schematic structural view of a laser engraving machine that constitutes an engraving CTP system shown in FIG. 1.

Before describing the printing relief plate C1, with reference to FIG. 3, a description will first be given of a laser engraving machine 40, which constitutes an engraving CTP system 18*b* (see FIG. 1) for producing a printing relief plate C1.

The laser engraving machine 40 includes an exposure head 42, a focused position changing mechanism 44, and an intermittent feeding mechanism 46.

The focused position changing mechanism 44 includes a motor 50 and a ball screw 52 for moving the exposure head 42 toward and away from a drum 48 on which a flexographic printing plate material (plate material) F1 is mounted. The focused position can be moved by controlling operation of the motor 50.

The intermittent feeding mechanism 46 moves a stage 54 with the exposure head 42 mounted thereon in an auxiliary scanning direction AS. The intermittent feeding mechanism 46 includes a ball screw 56, and an auxiliary scanning motor 58 for rotating the ball screw 56. By controlling the auxiliary scanning motor 58, the exposure head 42 is moved intermittently along the axis 60 of the drum 48.

A flexographic printing plate material F1 is secured to the drum 48 by a chuck 62, which is located in a position not exposed to the laser beam emitted from the exposure head 42. In this case, while the drum 48 rotates about its axis 60 in order to rotate the flexographic printing plate material F1, the exposure head 42 applies the laser beam L to the flexographic printing plate material F1 on the drum 48, for thereby performing a laser engraving process in order to form convexities or the like on the surface of the flexographic printing plate material F1. Upon continued rotation of the drum 48, if the chuck 62 passes in front of the exposure head 42, the exposure head 42 is intermittently fed along the auxiliary scanning direction AS, whereupon the exposure head 42 performs a laser engraving process along a next scanning line on the flexographic printing plate material F1.

The flexographic printing plate material F1 is moved along the main scanning direction MS upon rotation of the drum 48, and the exposure head 42 is fed intermittently and repeatedly along the auxiliary scanning direction AS, whereby the exposure operation position is controlled. Further, based on depth data D at each of the exposure operation positions, the intensity of the laser beam L is controlled and the laser beam L is turned on and off. As a result, convexities or the like are laser-engraved, thereby forming a relief of a desired shape on the surface (plate surface) of the flexographic printing plate material F1.

In this manner, the flexographic printing plate material F1, including the convexities formed thereon, is produced as a printing relief plate C1, and the printing relief plate C1 is installed in the flexographic printing press 20A.

Next, the printing relief plate C1 according to the first embodiment will be described with reference to FIGS. 4 through 7.

Figure 4:
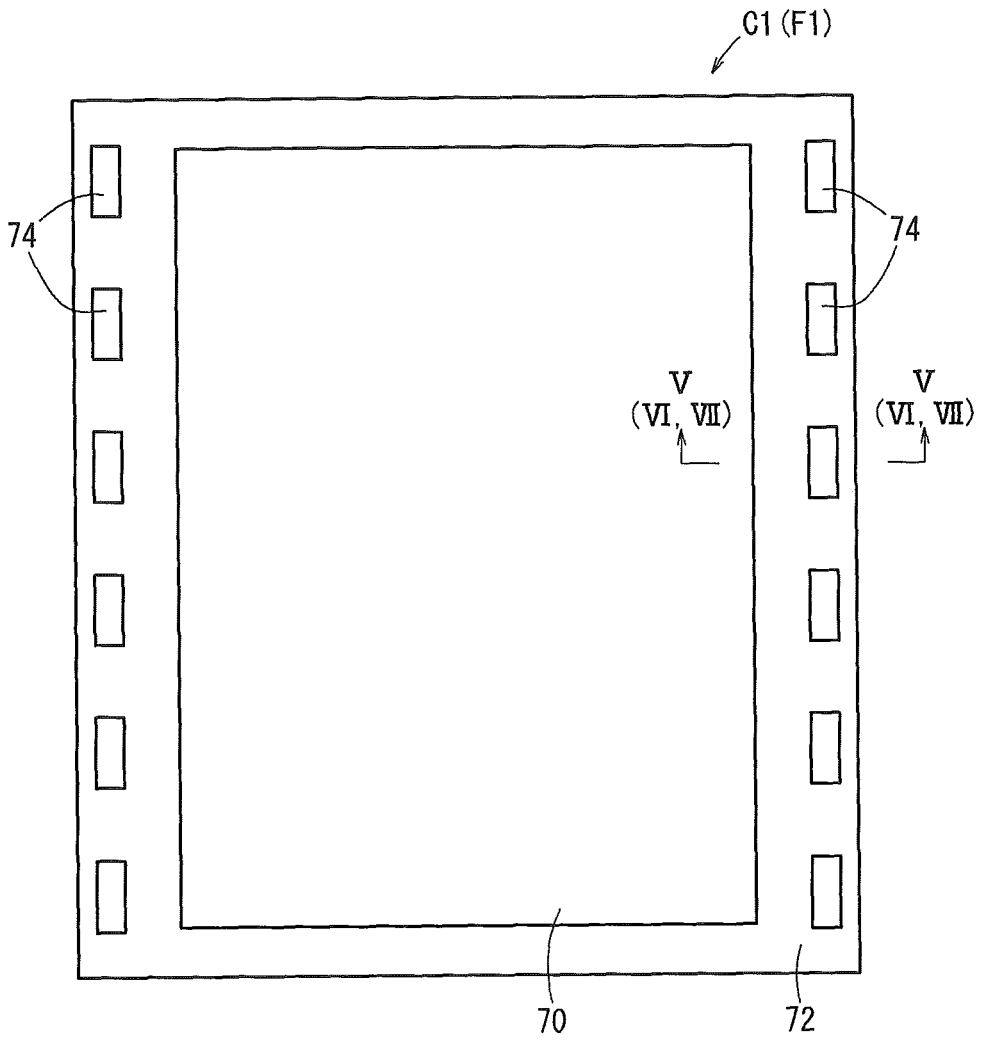
FIG. 4 is a schematic plan view of a printing relief plate produced by the printing relief plate producing apparatus of FIG. 1, according to the first embodiment.

As shown in FIG. 4, on a surface (plate surface) of the printing relief plate C1, on which ink is transferred from the anilox roller 28 (see FIG. 2), and by which the transferred ink is copied onto (transferred to) the print medium 32, there are formed an image forming region 70, a solid area 72, and a plurality of detecting portions 74 of substantially the same shape.

In this case, within the plate surface of the printing relief plate C1, which has a substantially rectangular shape, a frame shaped solid area 72 is formed along the four sides of the relief plate C1, and inside the solid area 72, an image forming region 70 is formed. Further, within the solid area 72, on two mutually confronting sides thereof, a plurality of rectangular detecting portions 74 are disposed at predetermined intervals.

Figure 5:
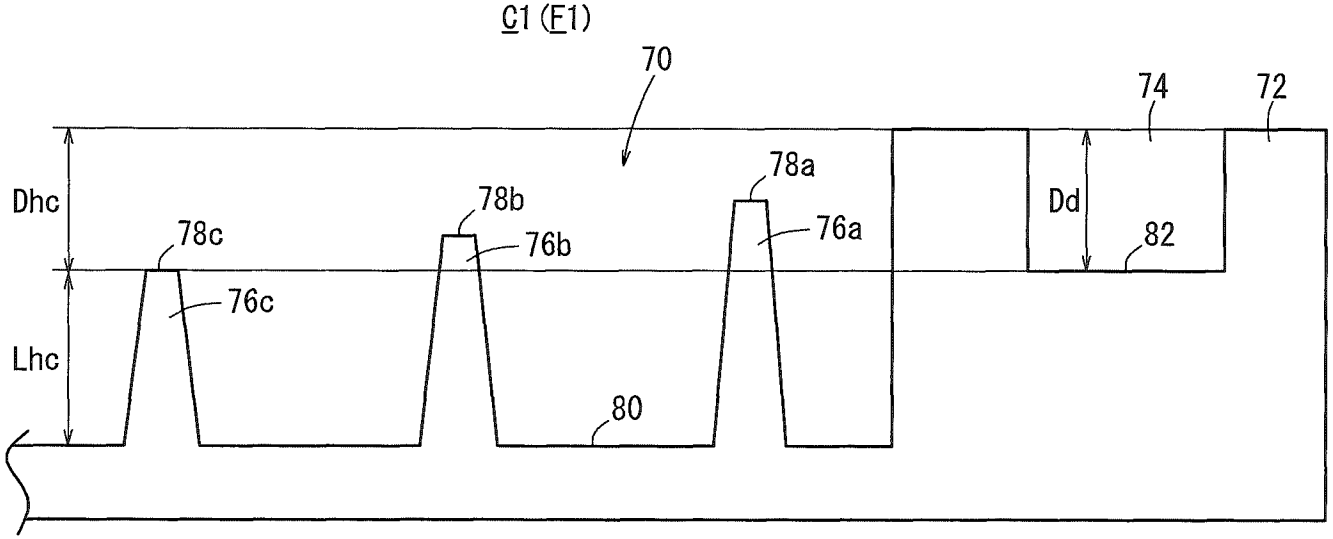
FIG. 5 is a cross sectional view taken along line V-V of FIG. 4.

As shown in FIGS. 4 and 5, the image forming region 70 is formed as a concave section, in which a central portion of the plate surface of the printing relief plate C1 is recessed downwardly (toward the plate cylinder 24), with a plurality of convexities 76*a* to 76*c* being formed in the concave section.

The convexities 76*a* to 76*c* are formed with trapezoidal shapes in cross section. Apexes 78*a* to 78*c* of the convexities 76*a* to 76*c* are set at positions lower than the height of the solid area 72. Further, although the apexes 78*a* to 78*c* are shown as flat shapes, in actuality, due to the processing accuracy of the laser engraving machine 40, cases may occur in which the apexes 78*a* to 78*c* have rounded shapes. According to the first embodiment, it is preferable for at least the apex 78*c* to have a flat shape.

Further, among the plural respective convexities 76*a* to 76*c*, the apex 78*c* of the convexity (highlight convexity) 76*c* is positioned lower than the apexes 78*a*, 78*b* of the other convexities 76*a*, 76*b*. In this case, a height from the bottom surface 80 of the concave section that makes up the image forming region 70 to the apex 78*c* is denoted by Lhc, and a depth from the height of the solid area 72 to the apex 78*c* is denoted by Dhc.

The height Lhc makes up part of the height level data Lh, which is supplied to the printing relief plate producing unit 18 from the plate shape determining unit 16, while the depth Dhc makes up part of the depth data D, which is supplied to the engraving CTP system 18*b* from the data converter 18*a*. More specifically, in the height level data Lh, there are included heights of the convexities 76*a* to 76*c* including the height Lhc, the height of the solid area 72, and heights of the detecting portions 74, whereas in the depth level data D, there are included depths of the convexities 76*a* to 76*c* including the depth Dhc, the depth of the solid area 72, and depths of the detecting portions 74. Stated otherwise, the aforementioned plate shape determining unit 16 (see FIG. 1) outputs the shapes of the solid area 72, the detecting portions 74, and the convexities 76*a* to 76*c*, which are formed on the plate surface of the printing relief plate C1, as height level data Lh to the printing relief plate producing unit 18.

On the other hand, in the solid area 72, plural detecting portions 74 are formed as recesses, which are recessed in a downward direction (toward the plate cylinder 24). So that the recesses can be distinguished from the convexities 76*a* to 76*c*, the recesses are formed to be wider than the convexities 76*a* to 76*c*. Depths Dd of bottom surfaces 82 of the recesses each are the same as the depth Dhc. Accordingly, as shown in FIG. 5, the height position of the apex 78*c* of the lowest convexity 76*c* coincides with the height position of the bottom surface 82 of each of the detecting portions 74.

Figure 6:
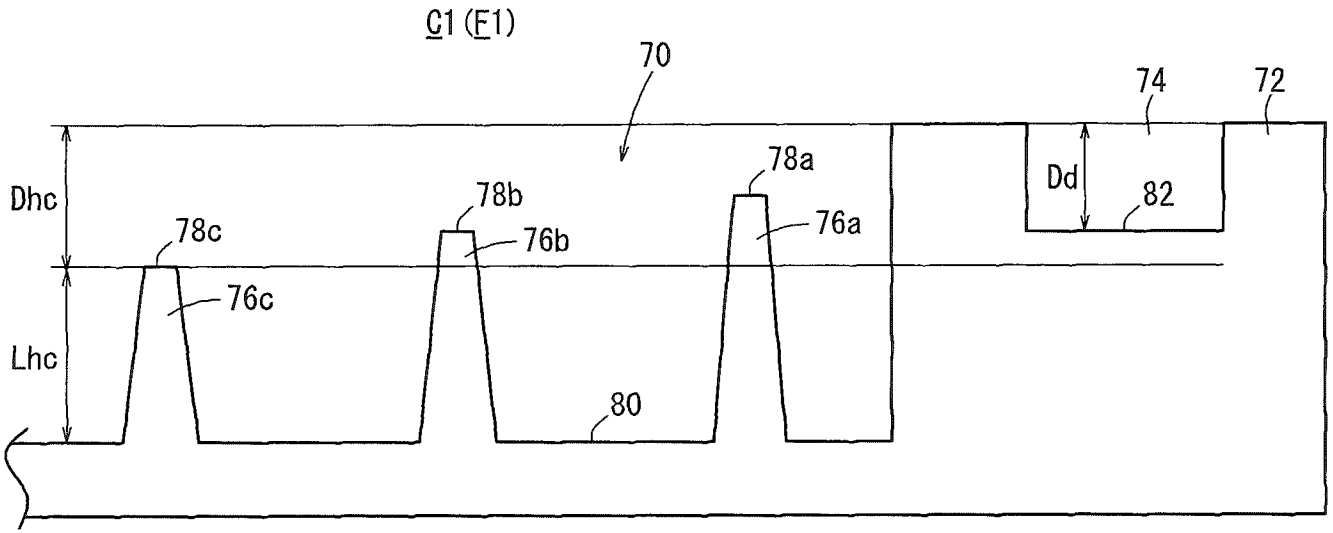
FIG. 6 is a cross sectional view taken along line VI-VI of FIG. 4.
Figure 7:
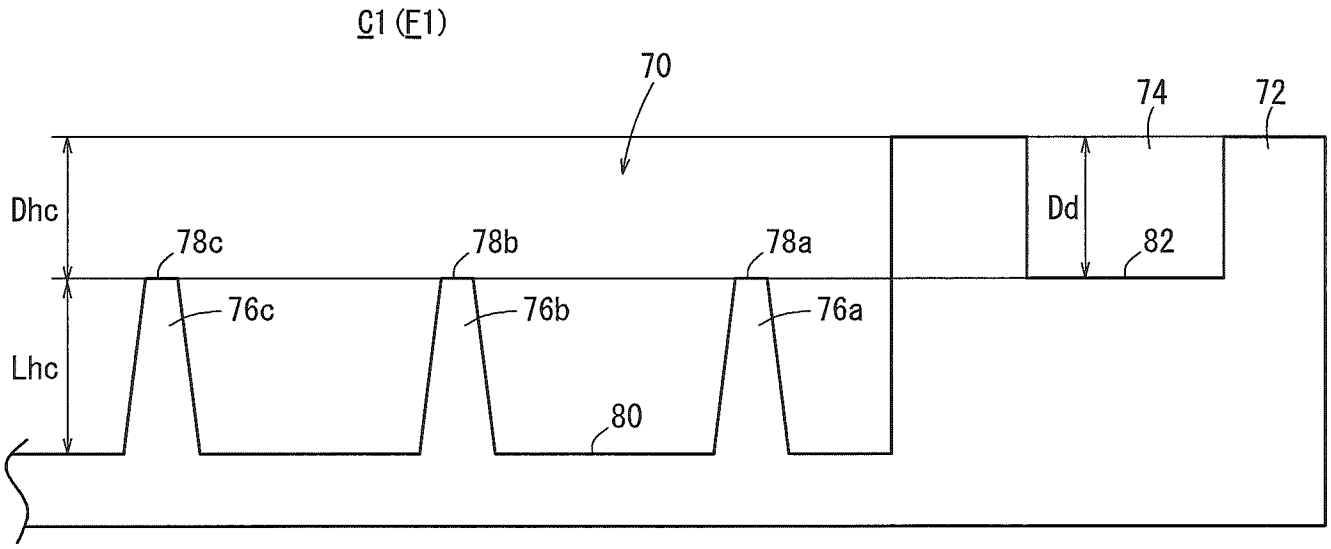
FIG. 7 is a cross sectional view taken along line VII-VII of FIG. 4.

As shown in FIG. 6, according to the first embodiment, the height positions of the bottom surfaces 82 of the detecting portions 74 may be set slightly higher than the height position of the apex 78*c* of the lowest convexity 76*c*, and as shown in FIG. 7, the height positions of the apexes 78*a*, 78*b* of the other convexities 76*a*, 76*b* may match with the height position of the apex 78*c* of the lowest convexity 76*c*.

More specifically, preferably, according to the first embodiment, (1) the apexes 78*a* to 78*c* and the bottom surfaces 82 are lower than the solid area 72, and (2) among the apexes 78*a* to 78*c*, the lowest apex 78*c* is set at substantially the same height as the bottom surfaces 82 (the apex 78*c* is set at the same height as the bottom surfaces 82, or the bottom surfaces 82 are set at a height slightly higher than the apex 78*c*).

In the case that the printing relief plate C1 configured as described above is mounted on the plate cylinder 24 through the cushion tape 22, ink is supplied to the plate surface of the printing relief plate C1 from the anilox roller 28, and if the plate surface comes into contact with the print medium 32 at an appropriate printing pressure, the plate surface is placed in a kiss-touch state with respect to the print medium 32.

Accordingly, ink attached to the solid area 72 is transferred securely to the print medium 32, and an image, the optical density of which corresponding to the solid area 72 is substantially 100% (a frame-shaped image, i.e., a solid area image, completely filled with ink and free of halftone dots), is printed on the print medium 32.

Further, ink supplied from the anilox roller 28 is accommodated inside the recesses of the detecting portions 74. In this case, the ink accommodated in the detecting portions 74 is transferred to the print medium 32 in a lightly touching manner. As a result, images (detecting portion images) corresponding to the shapes of the detecting portions 74 are printed on the print medium 32 with the optical density of the images being sufficiently low compared with the solid area image.

Furthermore, in the cavity of the image forming region 70 as well, ink supplied from the anilox roller 28 is accommodated. In this case, ink that is attached to the apexes 78*a* to 78*c* of the convexities 76*a* to 76*c* is transferred to the print medium 32 in a lightly touching manner. As a result, a halftone dot image (convexity image) corresponding to the shapes of the apexes 78*a* to 78*c* is printed on the print medium 32 with the optical density of the image being sufficiently low compared with the solid area image.

Among the aforementioned images, the convexity image, i.e., the halftone dot image, forms an image corresponding to a printed manuscript. Further, the lowest convexity 76*c* functions as a highlight convexity for printing highlight-forming halftone dots on the print medium 32. An anilox pressure applied from the anilox roller 28 to the plate surface of the printing relief plate C1 is set at a low pressure (minimum pressure), which is low but ink can be supplied to the convexity 76*c*. Furthermore, the appropriate printing pressure is defined as a sufficiently low optimum pressure (i.e., a pressure lower than a predetermined printing pressure threshold), such that ink attached to the apex 78*c* of the convexity 76*c*, which serves as a highlight convexity, can be transferred to the print medium 32 reliably, so that the highlight-forming halftone dots can be printed on the print medium 32.

On the other hand, if the printing pressure applied to the plate surface of the printing relief plate C1 is an excessive printing pressure (over-printing pressure) above the predetermined printing threshold, in addition to the ink attached to the solid area 72, ink accommodated in the detecting portions 74 also is transferred securely to the print medium 32. As a result, the optical density of the detecting portion images becomes substantially the same as the optical density of the solid area image, and the detecting portion images corresponding to the flat surface shape of the detecting portions 74 are printed on the print medium 32. Accordingly, if the optical density of the detecting portion images and the optical density of the solid area image are compared, and the optical density of the detecting portion images reaches the optical density of the solid area image, it can be determined easily that the printing pressure applied to the plate surface of the printing relief plate C1 has become an excessive printing pressure.

Further, plural detecting portions 74 are formed in the solid area 72. Thus, among the detecting portion images corresponding to the respective detecting portions 74, the number of detecting portion images that exhibit optical densities substantially equivalent to the optical density of the solid area image (i.e., the number of detecting portion images which are determined as having been printed at an excessive printing pressure), and the number of detecting portion images that exhibit optical densities lower than the optical density of the solid area image (i.e., the number of detecting portion images which are determined as having been printed at an appropriate printing pressure) are counted, and by means of a majority decision, i.e., if (the number of detecting portion images which are determined as having been printed at an excessive printing pressure)>(the number of detecting portion images which are determined as having been printed at an appropriate printing pressure), it may be determined that the printed pressure applied to the plate surface of the printing relief plate C1 is an excessive printing pressure.

[Printing Pressure Determining Method According to the First Embodiment]

The printing relief plate C1 according to the first embodiment is constructed basically as described above. Next, a method for determining whether the printing pressure applied to the printing relief plate C1 is either an appropriate printing pressure or an excessive printing pressure (operations, i.e., a printing pressure determining method, of the printing pressure determining apparatus 39A according to the first embodiment), based on the solid area image and the detecting portion images that are printed on a print P1 using the printing relief plate C1, will be described with reference to FIGS. 8 and 9. In the following descriptions, as necessary, reference may also be made to features shown in FIGS. 1 to 7.

For facilitating explanation, at first, a case will be described in which a judgment of an appropriate printing pressure or an excessive printing pressure is carried out, based on a comparison between the solid area image and a detecting portion image corresponding to one of the detecting portions 74. Next, a case will be described in which a judgment of an appropriate printing pressure or an excessive printing pressure is carried out by making respective comparisons between the solid area image and respective detecting portion images corresponding to multiple detecting portions 74, and then, by means of a majority decision concerning the respective judgment results, it is determined whether the printing pressure of the printing relief plate C1 is either an appropriate printing pressure or an excessive printing pressure.

Figure 8:
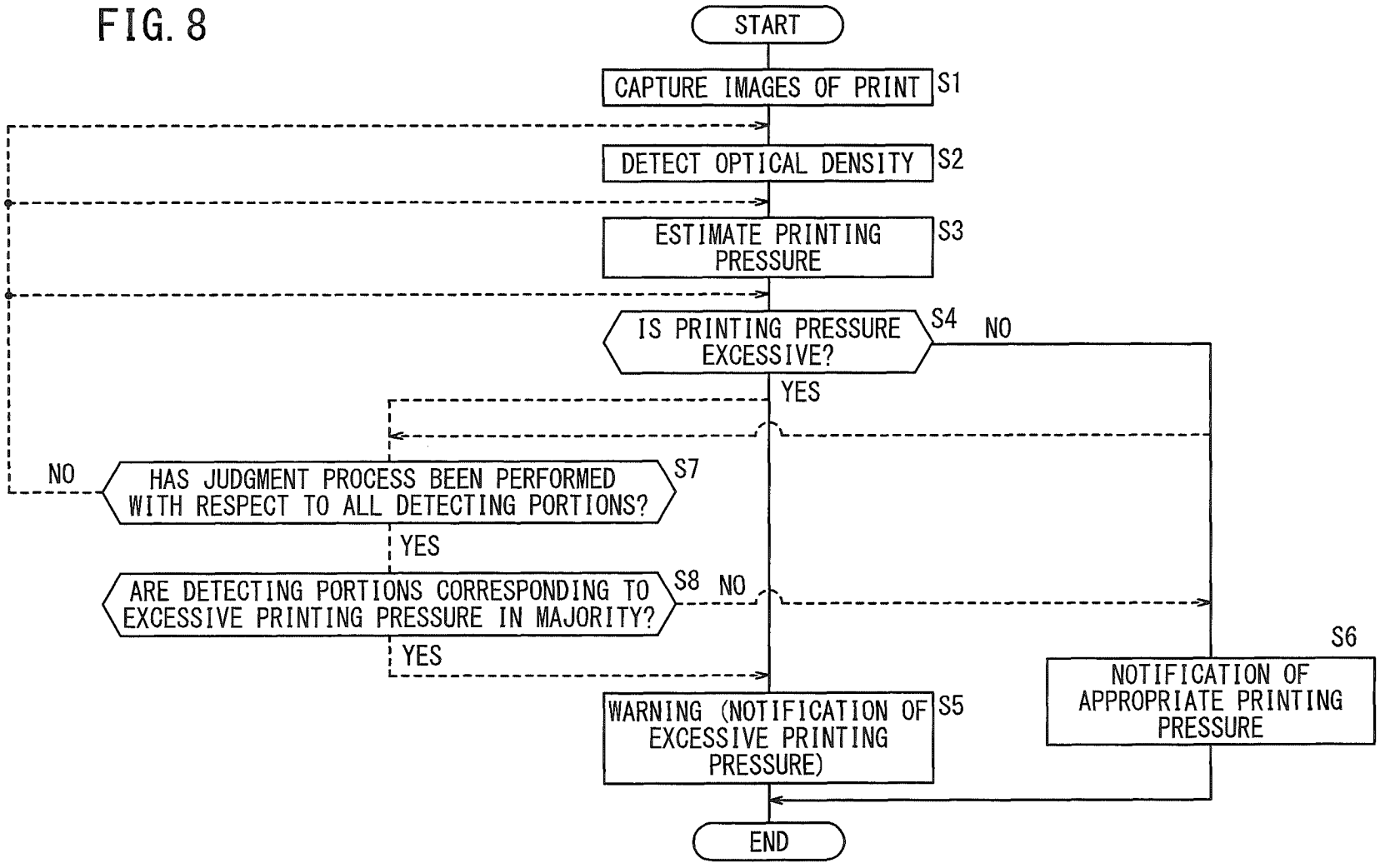
FIG. 8 is a flowchart showing operations (printing pressure determining method) of the printing pressure determining apparatus according to the first and second embodiments.

In step S1 of FIG. 8, the image capturing device 34 (see FIG. 2) captures various images including a solid area image and detecting portion images printed on the print P1, and outputs image signals representative of the captured images to the judgment processor 36.

In step S2, the judgment processor 36 detects respective optical densities of a solid area image and a detecting portion image indicated by the input image signals.

Figure 9:
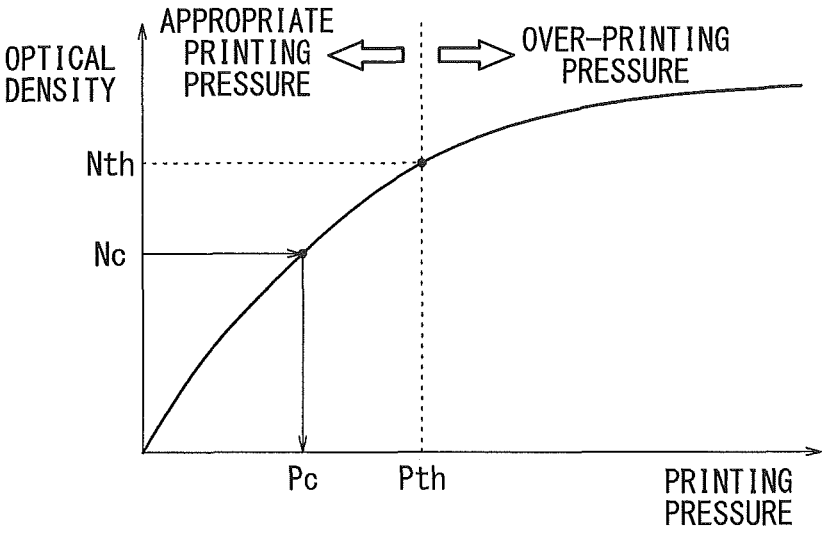
FIG. 9 is a descriptive drawing of a table showing a relationship between printing pressures and optical density, which is stored in a memory shown in FIG. 2.

In step S3, the judgment processor 36 refers to the table shown in FIG. 9, which is stored beforehand in the memory 38, the table indicating a relationship between the optical density Nc and the printing pressure Pc applied to the printing relief plate C1, and the printing pressure Pc is identified from the optical density Nc of the detecting portion image.

The optical density of the solid area image is a substantially 100% optical density, irrespective of differences in the appropriate printing pressure or the over-printing pressure, and is an optical density equal to or greater than a density threshold Nth. Owing thereto, the judgment processor 36 identifies the printing pressure Pc from the optical density Nc in relation only to the detecting portion image.

In step S4, the judgment processor 36 determines whether or not the printing pressure Pc has reached the print pressure threshold Pth (a printing pressure corresponding to the density threshold Nth). In the case that the inequality Pc≥Pth is satisfied (step S4: YES), the judgment processor 36 determines that the printing pressure Pc is an excessive printing pressure, and externally notifies a judgment result indicative of the over-printing pressure (step S5). On the other hand, if the inequality Pc<Pth is satisfied (step S4: NO), the judgment processor 36 determines that the printing pressure Pc is an appropriate printing pressure, and externally notifies a judgment result indicative of the appropriate printing pressure (step S6).

More specifically, if the printing pressure Pc is an appropriate printing pressure less than the printing pressure threshold Pth, the ink accommodated in the detecting portion 74 is transferred to the print medium 32 in a lightly touching manner, and the optical density of the detecting portion image formed by the transferred ink is sufficiently lower than the optical density (an optical density equal to or greater than the optical density threshold Nth) of the solid area image. On the other hand, if the printing pressure Pc is an excessive printing pressure equal to or greater than the printing pressure threshold Pth, the ink accommodated in the detecting portion 74 is transferred securely to the print medium 32, and the optical density of the detecting portion image formed by the transferred ink becomes an optical density (optical density threshold Nth) which is substantially equivalent to the optical density of the solid area image.

Accordingly, by comparing the printing pressure Pc corresponding to the optical density Nc of the detecting portion image with the printing pressure threshold Pth corresponding to the density threshold Nth, which is the minimum value of the optical density of the solid area image, the printing pressure Pc can easily be judged as being either an appropriate printing pressure or an excessive printing pressure, and the judgment result can be notified (i.e., output) to the exterior.

Moreover, as described above, since the optical density corresponding to the printing pressure threshold Pth is the density threshold Nth, in step S4, the judgment processor 36 may determine whether the printing pressure Pc is either an appropriate printing pressure or an excessive printing pressure, based on a comparison between the optical density Nc and the density threshold Nth.

In the above description, an explanation has been given concerning a judgment process of an appropriate printing pressure or an over-printing pressure, based on a comparison between a solid area image corresponding to the solid area 72 and a detecting portion image corresponding to a single detecting portion 74.

Next, a description shall be given concerning a case of performing a judgment process of an appropriate printing pressure or an over-printing pressure, based on comparisons between a solid area image and respective detecting portion images corresponding to a plurality of detecting portions 74.

In step S1, the image capturing device 34 captures various images including a solid area image and a plurality of detecting portion images printed on the print P1, and outputs image signals representative of the captured images to the judgment processor 36.

In step S2, the judgment processor 36 detects respective optical densities of a solid area image and the detecting portion images indicated by the input image signals.

In step S3, the judgment processor 36 refers to the table shown in FIG. 9, which is stored beforehand in the memory 38, and printing pressures Pc are identified respectively from the optical densities Nc of the plural detecting portion images.

In step S4, the judgment processor 36 compares one printing pressure Pc among the identified plural printing pressures Pc with the printing pressure threshold Pth. In the case, even if the inequality Pc≥Pth is satisfied (step S4: YES), or even if the inequality Pc<Pth is satisfied (step S4: NO), the judgment processor 36 implements the process of the following step S7.

In the following step S7, if the judgment process of step S4 has not been completed with respect to the plural printing pressures Pc corresponding to all of the detecting portion images (step S7: NO), the judgment processor 36 returns to step S4, and the judgment process is implemented on any printing pressures Pc for which the judgment process has not yet been implemented.

On the other hand, if the judgment process has been completed with respect to all of the plural printing pressures Pc (step S7: YES), then in step S8, the judgment processor 36 determines, with respect to all of the printing pressures Pc, whether or not the number of printing pressures Pc judged to be excessive (over-printing pressures) represents a majority.

If the number of printing pressures Pc judged to be excessive is in the majority, the judgment processor 36 determines that the printing pressure of the printing relief plate C1 is an excessive printing pressure (step S8: YES), and the process of step S5 is carried out. On the other hand, if the number of printing pressures Pc judged to be excessive does not reach a majority (in other words, if the number of printing pressures Pc judged to be appropriate printing pressures is in the majority), the judgment processor 36 determines that the printing pressure of the printing relief plate C1 is an appropriate printing pressure (step S8: NO), and the process of step S6 is carried out.

In step S2, the judgment processor 36 may detect an optical density of only one detecting portion image from among the plural detecting portion images represented by the input image signals. In this case, if the judgment process with respect to all of the detecting portion images is not completed at step S7, step S2 is returned to, and the processes of steps S2 through S4 are carried out again.

Further, in step S3, the judgment processor 36 may identify a printing pressure Pc in relation to an optical density Nc of one detecting portion image from among the optical densities of the plural detecting portion images. In this case, if the judgment process with respect to all of the detecting portion images is not completed at step S7, step S3 is returned to, and the processes of steps S3 and S4 are carried out again.

[Effects of the First Embodiment]

As has been described above, according to the first embodiment, with the printing relief plate C1, the lowest convexity 76*c* and the detecting portions 74 are set at substantially the same height. Therefore, for example, even if the anilox pressure is set at a minimum pressure in compliance with the printing conditions of the print medium 32, ink can be supplied to the detecting portion 74 and the convexity 76*c*, which are of substantially the same height, and the ink attached to the detecting portion 74 can be transferred reliably to the print medium 32, whereby the detecting portion image is printed. Accordingly, by comparing the optical density Nc of the detecting portion image with the optical density (density threshold Nth) of the solid area image, irrespective of the magnitude of the anilox pressure, the printing pressure Pc can easily be judged as being either an appropriate printing pressure or an excessive printing pressure.

Further, on the plate surface of the printing relief plate C1, the solid area 72 is a flat portion having an area equal to or greater than a certain fixed area, which is positioned higher than other portions making up the printing relief plate C1. For this reason, in the case that the printing pressure Pc is an appropriate printing pressure, the plate surface of the printing relief plate C1 is in a kiss-touch state with respect to the print medium 32, whereby ink is transferred securely to the print medium 32 from the solid area 72, together with ink being transferred to the print medium 32 from the detecting portion 74 in a lightly touching manner. In this case, the optical density of the solid area image is substantially 100%, whereas the density Nc of the detecting portion image is of a sufficiently low density compared to the solid area image.

On the other hand, if the printing pressure Pc is an excessive printing pressure (i.e., a pressure equal to or greater than the printing pressure threshold Pth), since ink is securely transferred to the print medium 32 from the detecting portion 74, the optical density Nc of the detecting portion image becomes substantially equivalent to the density of the solid area image. Thus, by comparing the optical density Nc of the detecting portion image with the optical density of the solid area image, it can be judged easily whether or not the printing pressure Pc is an excessive printing pressure.

Furthermore, the detecting portion 74 is a recess formed in the solid area 72, wherein the height position of the bottom surface 82 of the recess is substantially the same as the height position of the apex 78*c* of the convexity 76*c*. Therefore, ink supplied from the anilox roller 28 is accommodated in the recess, and the ink accommodated therein can be transferred reliably to the print medium 32.

Still further, if at least the apex 78*c* of the convexity 76*c* is formed as a flat portion, the quality of the image (halftone dot) formed by ink that is transferred to the print medium 32 from the convexity 76*c* can be improved.

Moreover, each of the aforementioned effects can be obtained easily even if the detecting portion 74 is placed at the same height position as that of the convexity 76*c*, or is placed at a slightly higher height position than the convexity 76*c*. Furthermore, it goes without saying that the aforementioned effects can also be obtained even in the case that the convexities 76*a* to 76*c* are set at positions of the same height as the convexity 76*c*.

Furthermore, cases may occur in which a height variance (height distribution) exists to some degree over the entirety of the printing relief plate C1. Thus, a plurality of individual detecting portions 74 may be provided, and by a majority decision based on the comparison result between the optical density of the solid area image and optical densities Nc of the detecting portion images, it can be determined whether the printing pressure Pc is an appropriate printing pressure or an excessive printing pressure. In this manner, the influence of any height variance of the detecting portions 74 on the printing pressure judgment result can be suppressed, and a determination can be carried out reliably and more accurately as to whether the printing pressure is an appropriate printing pressure or an excessive printing pressure.

In addition, since all of the aforementioned printing relief plate producing apparatus 10A, the printing relief plate producing method, the flexographic printing press 20A, the printing method, the printing pressure determining apparatus 39A, and the printing pressure determining method are a method or apparatus related to the aforementioned printing relief plate C1, the same advantages and effects of the printing relief plate C1 can be achieved.

In the foregoing descriptions, cases have been described in which it is automatically determined, by means of the printing pressure determining apparatus 39A and the printing pressure determining method, whether the printing pressure Pc is either an appropriate printing pressure or an excessive printing pressure. In the first embodiment, whether the printing pressure Pc is either an appropriate printing pressure or an excessive printing pressure may be judged based on a comparison between the optical density Nc (or the printing pressure Pc corresponding to the optical density Nc) of the detecting portion image and the density (or the printing pressure threshold Pth corresponding to the density threshold Nth) of the solid area image. For this reason, it also is possible for an operator, by visual observation, to compare the optical density Nc of the detecting portion image and the density of the solid area image, and to thereby determine whether the printing pressure Pc is either an appropriate printing pressure or an excessive printing pressure.

[Description of Printing Relief Plate Producing Apparatus, Printing Relief Plate Producing Method, Printing Apparatus, Printing Method, and Printing Pressure Determining Apparatus According to the Second Embodiment]

Next, a second embodiment of the present invention will be described.

The second embodiment of the present invention will be described only in relation to differences thereof from the first embodiment. Accordingly, constituent elements in the second embodiment, which are the same as those of the first embodiment, are denoted by the same reference characters, and detailed description of such features will be omitted.

As shown in FIG. 1, a printing relief plate producing apparatus 10B according to the second embodiment of the present invention also is constituted from the RIP processor 12, the screening processor 14, the plate shape determining unit 16, and the printing relief plate producing unit 18, as is the case in the printing relief plate producing apparatus 10A according to the first embodiment.

However, in the printing relief plate producing apparatus 10B according to the second embodiment, in order to produce the printing relief plate C2 according to the second embodiment, the plate shape determining unit 16 converts the binary image data Ib into height level data Lh and width level data Lw corresponding to a desired shape (step of generating shape data). In this case, the width level data Lw is shape data that represents the width of the recesses and the like.

Moreover, as described later, the engraving CTP system 18*b* performs a laser engraving process on a flexographic printing plate material in a width direction thereof, for thereby producing the printing relief plate C2. Owing thereto, the plate shape determining unit 16 may generate height level data Lh while taking into account the widths of the recesses, etc., and generation of the width level data Lw can be omitted.

The data converter 18*a* of the printing relief plate producing unit 18 converts the height level data Lh into depth data D. Based on the depth data D (and the width level data Lw), the engraving CTP system 18*b* performs a laser engraving process on a flexographic printing plate material, for thereby producing the printing relief plate C2 on which a plurality of convexities and recesses or the like are formed (step of producing the printing relief plate).

As shown in FIG. 2, the flexographic printing press 20B, which serves as a printing apparatus according to the second embodiment, differs from the flexographic printing press 20A according to the first embodiment, in that the printing relief plate C2 is mounted on the plate cylinder 24 through the cushion tape 22.

Therefore, ink is transferred from the anilox roller 28 onto convexities or the like, which are formed on the surface of the printing relief plate C2 (step of transferring ink to the printing relief plate), and then the ink applied to the convexities is transferred (copied) onto a print medium 32 such as a corrugated cardboard material or the like, which is gripped and fed between the plate cylinder 24 on which the printing relief plate C2 is mounted and the impression cylinder 30, whereby various images including halftone dots are formed (printed) on the print medium 32, thereby producing a desired print P2 (step of printing halftone dots).

The printing pressure determining apparatus 39B according to the second embodiment comprises the same structure as the printing pressure determining apparatus 39A according to the first embodiment.

The image capturing device 34 captures an image that is printed on the print P2, and outputs an image signal representing the captured image to the judgment processor 36. The judgment processor 36 refers to a table stored in the memory 38, which is indicative of a relationship between an optical density of a predetermined portion and the printing pressure applied to the plate surface of the printing relief plate C2 during printing thereof, and identifies (estimates) the printing pressure corresponding to the detected optical density. Accordingly, if the identified printing pressure is less than a predetermined printing pressure threshold, the judgment processor 36 can determine that the print P2 has been printed at an optimum printing pressure (appropriate printing pressure), whereas if the identified printing pressure is equal to or greater than the predetermined printing pressure threshold, the judgment processor 36 can determine that the print P2 has been printed at an excessive printing pressure (over-printing pressure).

In the second embodiment, the laser engraving machine 40 is the same as that used in the first embodiment. However, in the case of the second embodiment, the flexographic printing plate material F2 is moved along the main scanning direction MS upon rotation of the drum 48, and the exposure head 42 is fed intermittently and repeatedly along the auxiliary scanning direction AS, whereby the exposure operation position is controlled, and based on depth data D (and width level data Lw) at each of the exposure operation positions, the intensity of the laser beam L is controlled and the laser beam L is turned on and off. As a result, convexities or the like are laser-engraved, thereby forming a relief of a desired shape on the surface (plate surface) of the flexographic printing plate material F2. Thus, in this manner, the flexographic printing plate material F2, including convexities or the like which are formed thereon, is produced as a printing relief plate C2, and the printing relief plate C2 is installed in the flexographic printing press 20B.

[Description of Printing Relief Plate According to the Second Embodiment]

Next, the printing relief plate C2 according to the second embodiment will be described with reference to FIGS. 10 through 15.

Figure 10:
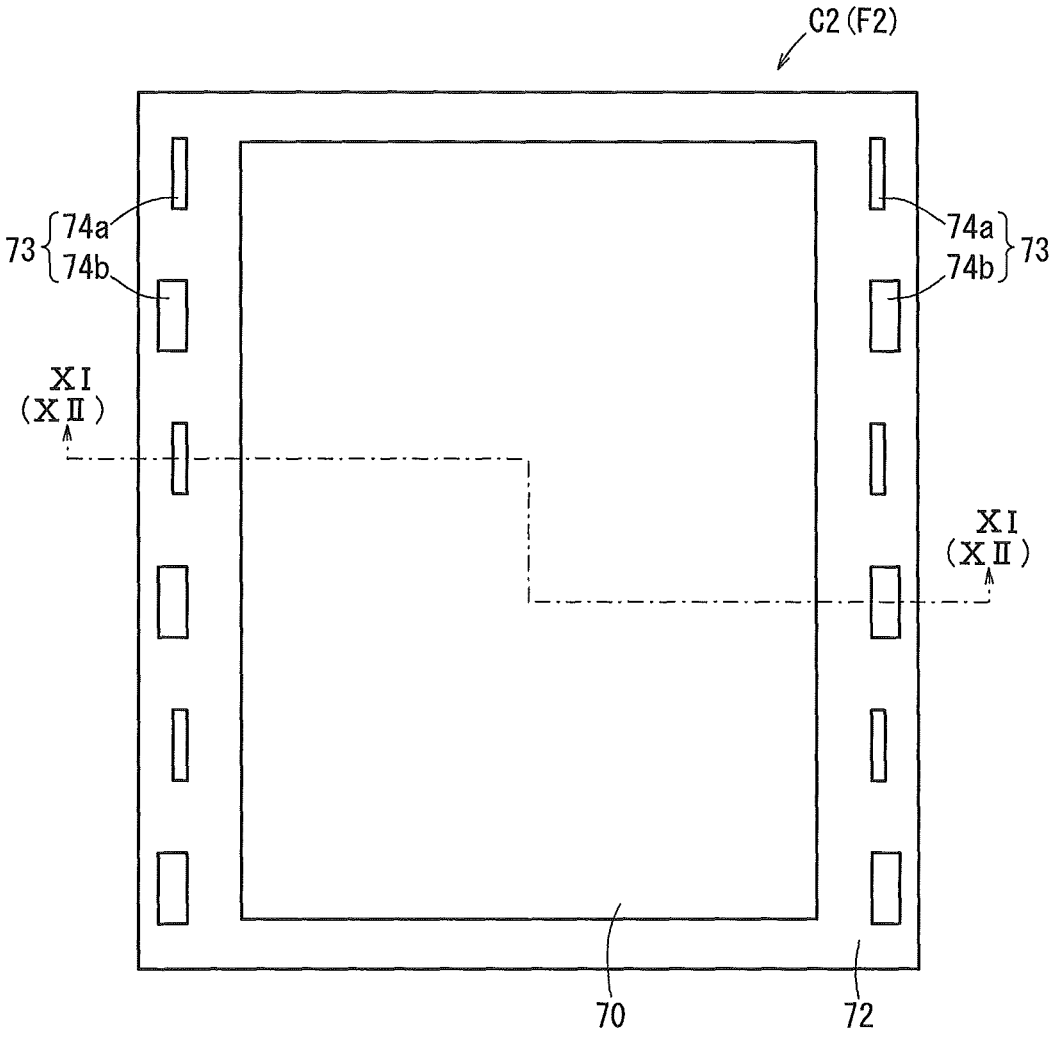
FIG. 10 is a schematic plan view of a printing relief plate produced by the printing relief plate producing apparatus of FIG. 1, according to the second embodiment.

As shown in FIG. 10, on a surface (plate surface) of the printing relief plate C2, on which ink is transferred from the anilox roller 28 (see FIG. 2), and by which the transferred ink is copied onto (transferred to) the print medium 32, there are formed an image forming region 70, a solid area 72, and a plurality of detecting portion units 73.

In this case, within the plate surface of the printing relief plate C2, which has a substantially rectangular shape, a frame shaped solid area 72 is formed along the four sides of the relief plate C2, and inside the solid area 72, an image forming region 70 is formed. Further, within the frame shaped solid area 72, on two mutually confronting sides thereof, a plurality of detecting portion units 73 are disposed at predetermined intervals. Each of the detecting portion units 73 includes two rectangular shaped detecting portions 74*a*, 74*b*, which differ from each other in width.

As shown in FIG. 10, the detecting portions 74*a* of the detecting portion units 73 are both of the same shape, and the detecting portions 74*b* are also both of the same shape. However, the lateral widths of the detecting portions 74*a* are narrower than the lateral widths of the detecting portions 74*b*.

Figure 11:
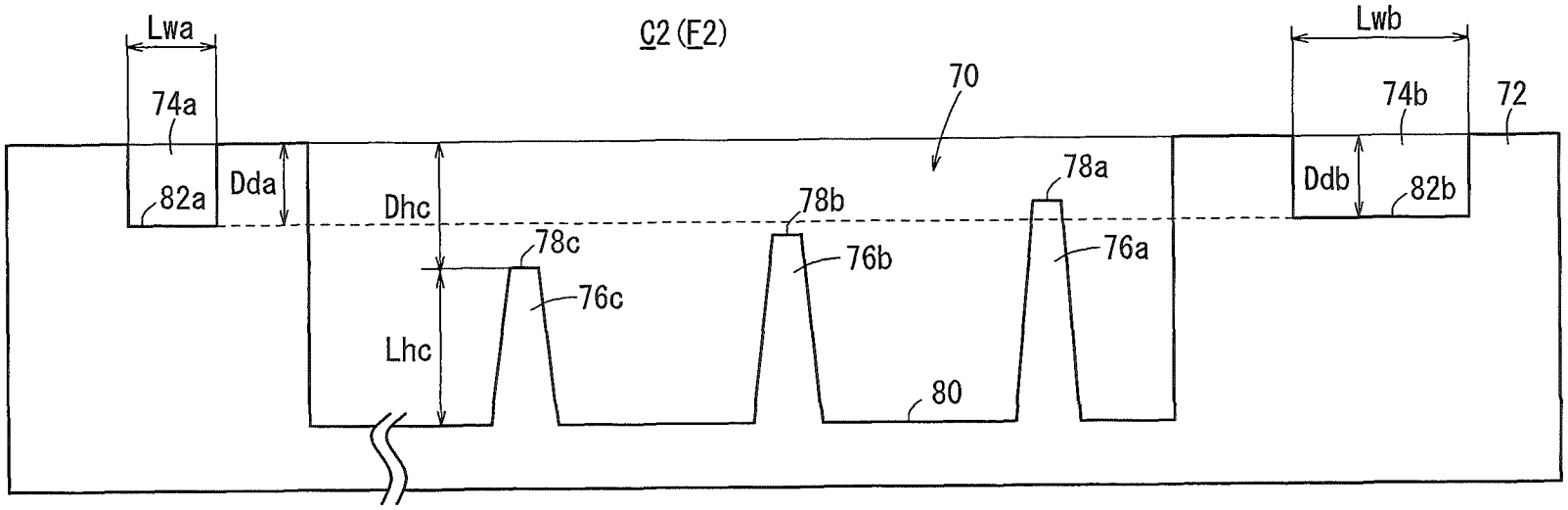
FIG. 11 is a cross sectional view taken along line XI-XI of FIG. 10.

Further, as shown in FIGS. 10 and 11, similar to the first embodiment, in the second embodiment, plural convexities 76*a* to 76*c* are formed in the concavity in the central portion of the plate surface of the printing relief plate C2, which serves as the image forming region 70.

A height Lhc forms a portion of the height level data Lh, which is supplied to the printing relief plate producing unit 18 from the plate shape determining unit 16 (see FIG. 1), and a depth Dhc forms a portion of the depth level data D, which is supplied to the engraving CTP system 18*b* from the data converter 18*a*. More specifically, in the height level data Lh, there are included the heights of the convexities 76*a* to 76*c* including the height Lhc, the height of the solid area 72, and the heights of the detecting portions 74*a*, 74*b*, and in the depth level data D, there are included the depths of the convexities 76*a* to 76*c* including the depth Dhc, the depth of the solid area 72, and the depths of the detecting portions 74*a*, 74*b*. Stated otherwise, the plate shape determining unit 16 (see FIG. 1) outputs the shapes of the solid area 72, the detecting portions 74*a*, 74*b*, and the convexities 76*a* to 76*c*, which are formed on the plate surface of the printing relief plate C2, as height level data Lh to the printing relief plate producing unit 18.

On the other hand, the two types of detecting portions 74*a*, 74*b* that constitute the plural detecting portion units 73 are formed as recesses, which are recessed in a downward direction (toward the plate cylinder 24) in the solid area 72. So that the recesses can be distinguished from the convexities 76*a* to 76*c*, the recesses are formed to be wider than each of the convexities 76*a* to 76*c*.

Concerning each of the detecting portions 74*a*, which are formed as recesses, the depth of the bottom surfaces 82*a* thereof is denoted by Dda, and the width in the lateral direction of FIGS. 10 and 11 is denoted by Lwa. Further, concerning each of the detecting portions 74*b*, which are formed as recesses, the depth of the bottom surfaces 82*b* thereof is denoted by Ddb, and the width in the lateral direction is denoted by Lwb. In the structure shown in FIG. 11, the inequalities Lwa<Lwb and Dda=Ddb<Dhc are satisfied, and the height position of the bottom surfaces 82*a*, 82*b* of the detecting portions 74*a*, 74*b* is set to be higher than the height position of the apex 78*c* of the lowest convexity 76*c*.

Figure 12:
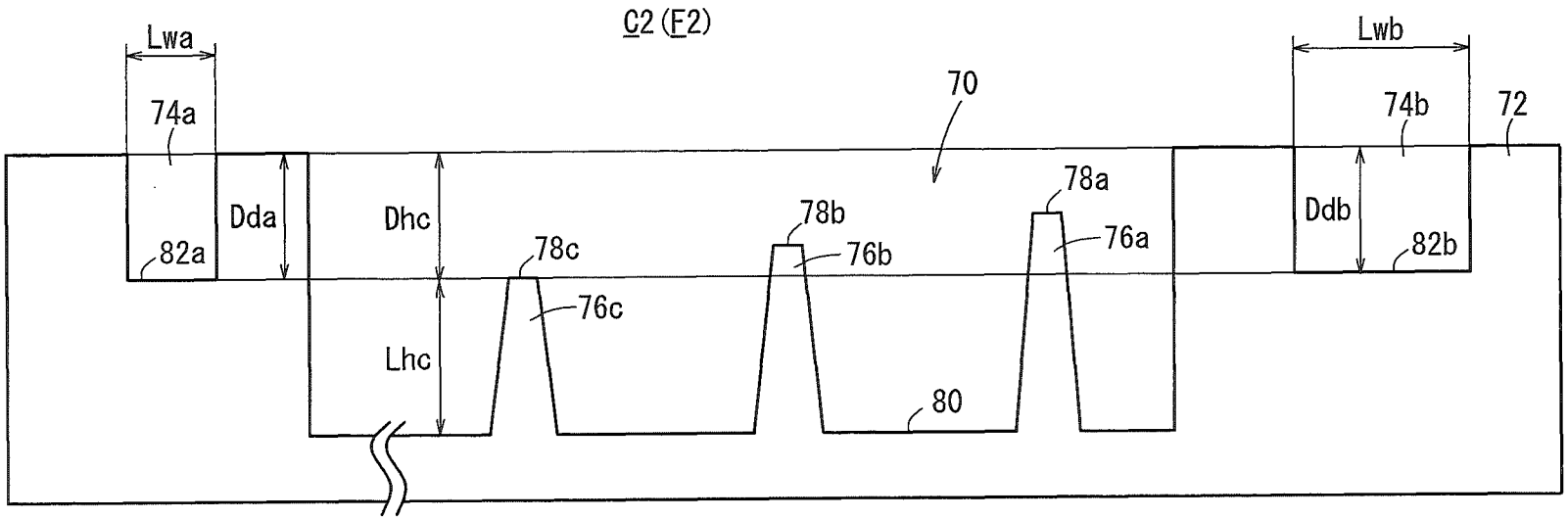
FIG. 12 is a cross sectional view taken along line XII-XII of FIG. 10.

Moreover, as shown in FIG. 12, according to the second embodiment, the height position of the apex 78*c* of the lowest convexity 76*c* may coincide with the height position of the bottom surfaces 82*a*, 82*b* of the respective detecting portions 74*a*, 74*b*.

More specifically, preferably, according to the second embodiment, (1) the apexes 78*a* to 78*c* and the bottom surfaces 82*a*, 82*b* are lower than the solid area 72, and (2) the bottom surfaces 82*a*, 82*b* are set to be higher than the lowest apex 78*c*, or alternatively, the lowest apex 78*c* and the bottom surfaces 82*a*, 82*b* are set at the same height. Further, with the second embodiment, in each of the detecting portion units 73, the widths of at least the two detecting portions 74*a*, 74*b* preferably are mutually different from each other. Consequently, according to the second embodiment, a single detecting portion unit 73 can be constructed by three or more detecting portions, the widths of which differ mutually from each other.

In the case that the printing relief plate C2 configured as described above is mounted on the plate cylinder 24 through the cushion tape 22, ink is supplied to the plate surface of the printing relief plate C2 from the anilox roller 28, and if the plate surface comes into contact with the print medium 32 at an appropriate printing pressure, the plate surface is placed in a kiss-touch state with respect to the print medium 32.

Accordingly, ink attached to the solid area 72 is transferred securely to the print medium 32, and an image which corresponds to the shape of the solid area 72 with the optical density thereof being substantially 100% (a frame-shaped image, i.e., solid area image, completely filled with ink and free of halftone dots), is printed on the print medium 32.

Further, ink supplied from the anilox roller 28 also is accommodated inside the concavity of the image forming region 70. In this case, the accommodated ink, which is attached to the apexes 78*a* to 78*c* of the respective convexities 76*a* to 76*c*, is transferred to the print medium 32 in a lightly touching manner. As a result, a halftone dot image (convexity image) corresponding to the shapes of the apexes 78*a* to 78*c* with the optical density thereof being sufficiently low compared with the solid area image, is printed on the print medium 32.

In this case, the convexity image, i.e., the halftone dot image, forms an image corresponding to a printed manuscript. Further, the lowest convexity 76*c* functions as a highlight convexity for printing highlight-forming halftone dots on the print medium 32. An anilox pressure applied from the anilox roller 28 to the plate surface of the printing relief plate C1 is set at a low pressure (minimum pressure), which is low but ink can be supplied to the convexity 76*c*. Furthermore, the appropriate printing pressure is defined as a sufficiently low optimum pressure (i.e., a pressure lower than a predetermined printing pressure threshold), such that ink attached to the apex 78*c* of the convexity 76*c*, which serves as a highlight convexity, can be transferred to the print medium 32 reliably, so that the highlight-forming halftone dots can be printed on the print medium 32.

Furthermore, ink supplied from the anilox roller 28 is accommodated inside the recesses of the detecting portions 74*a*, 74*b*. A description shall now be given, with reference to FIGS. 13 to 15, concerning the transfer of ink accommodated in the detecting portions 74*a*, 74*b* to the print medium 32.

Figure 13:
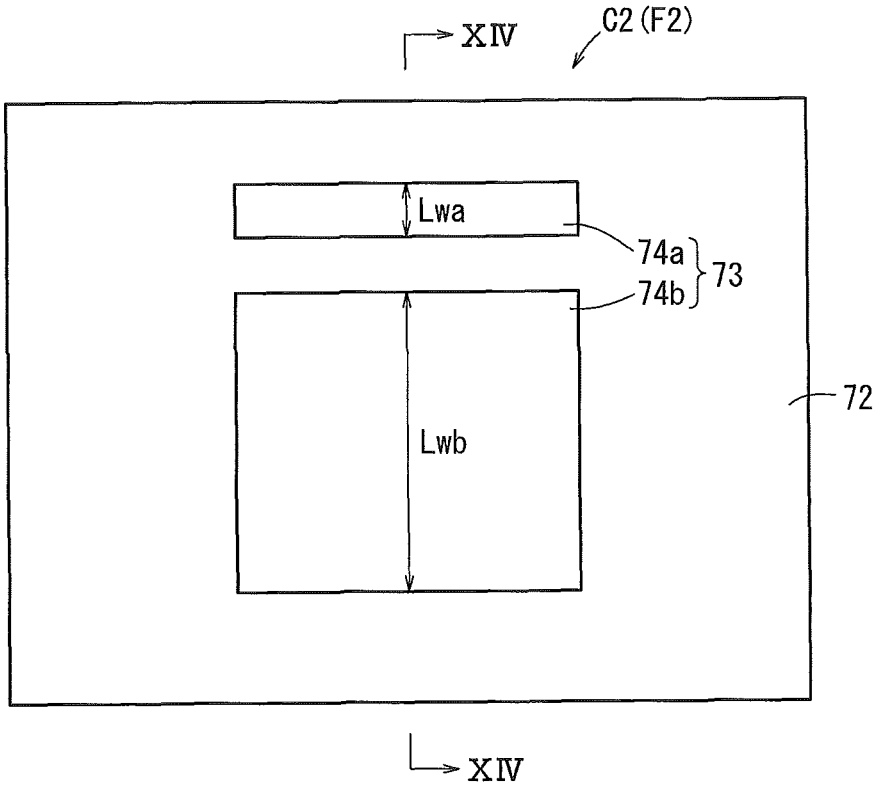
FIG. 13 is a schematic plan view in which two detecting portions having different widths are shown.

As shown schematically in FIGS. 13 and 14, for facilitating explanation, a case will be described in which only one detecting portion unit 73, which is constituted from two detecting portions 74*a*, 74*b*, is provided.

Figure 14:
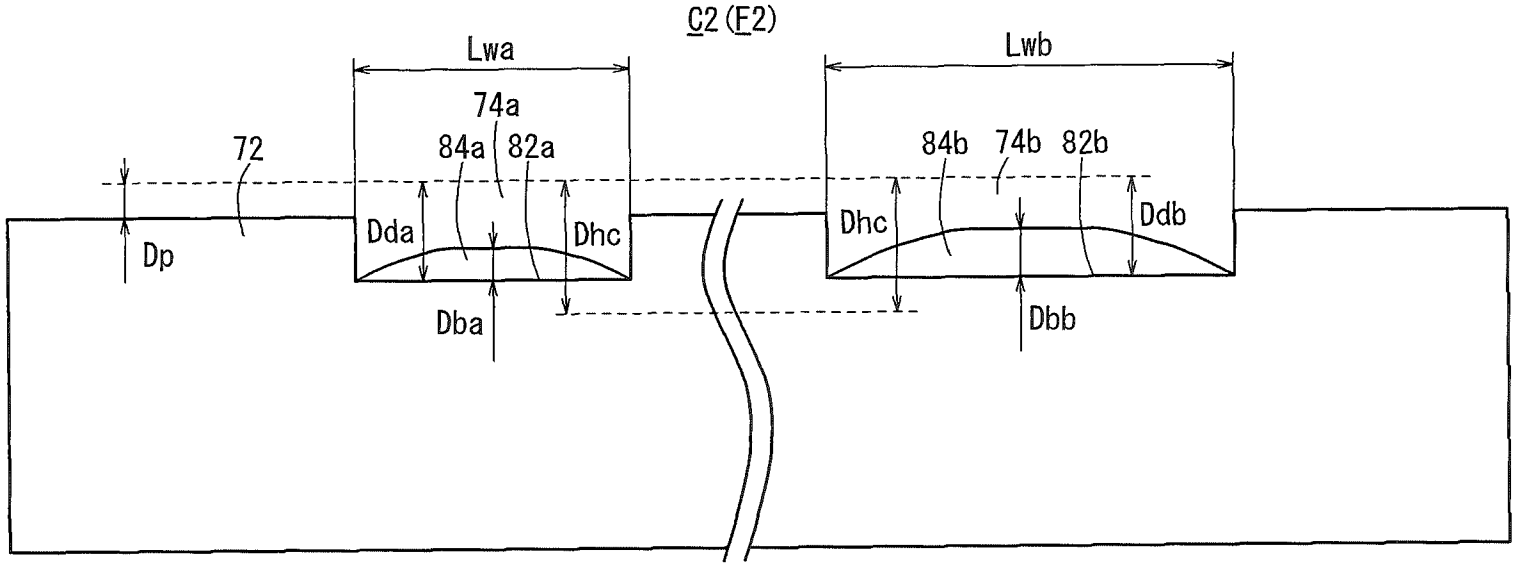
FIG. 14 is a cross sectional view taken along line XIV-XIV of FIG. 13.

As shown in FIG. 14, ink 84*a* is accommodated in the recess of the detecting portion 74*a*, and ink 84*b* is accommodated in the recess of the detecting portion 74*b*. A maximum height from the bottom surface 82*a* of the ink 84*a* accommodated in the detecting portion 74*a* is denoted by Dba, and a maximum height from the bottom surface 82*b* of the ink 84*b* accommodated in the detecting portion 74*b* is denoted by Dbb.

In the event that the print medium 32 is gripped and transferred between the plate cylinder 24 and the impression cylinder 30 and ink is transferred from the printing relief plate C2 to the print medium 32, since a printing pressure is applied to the plate surface of the printing relief plate C2, as shown in FIG. 14, the plate surface (upper surface) of the printing relief plate C2, which is a contact surface with the print medium 32, is compressed toward the plate cylinder 24 at a depth Dp. As a result, the shapes of the recesses of the respective detecting portions 74*a*, 74*b* are deformed.

As described above, since the inequality Lwa<Lwb is satisfied, the amount of ink 84*b* accommodated in the detecting portion 74*b* is greater than the amount of ink 84*a* accommodated in the detecting portion 74*a*, while in addition, by means of the printing pressure, the detecting portion 74*b* is deformed to a greater degree than the detecting portion 74*a*. Owing thereto, the amount of ink 84*b* transferred to the print medium 32 from the detecting portion 74*b* is greater than the amount of ink 84*a* transferred to the print medium 32 from the detecting portion 74*a*. As a result, the application of ink 84*a* to the print medium 32 from the detecting portion 74*a*, and the application of ink 84*b* to the print medium 32 from the detecting portion 74*b* differ mutually from each other.

More specifically, the image (detecting portion image) corresponding to the shape of the detecting portion 74*b* that is formed on the print medium 32 from the ink 84*b* is wider and of a higher optical density than the detecting portion image corresponding to the shape of the detecting portion 74*a* that is formed on the print medium 32 from the ink 84*a*.

However, since the bottom surfaces 82*a*, 82*b* of the detecting portions 74*a*, 74*b* are positioned lower than the solid area 72, if an appropriate printing pressure is applied to the printing relief plate C2, compared to the ink that is attached to the solid area 72, the inks 84*a*, 84*b* are transferred to the print medium 32 in a lightly touching manner. As a result, the detecting portion images formed on the print medium 32 corresponding to the detecting portions 74*a*, 74*b* have mutually different widths and optical densities, and the optical densities thereof are of a sufficiently low optical density in comparison with the solid area image.

Figure 15:
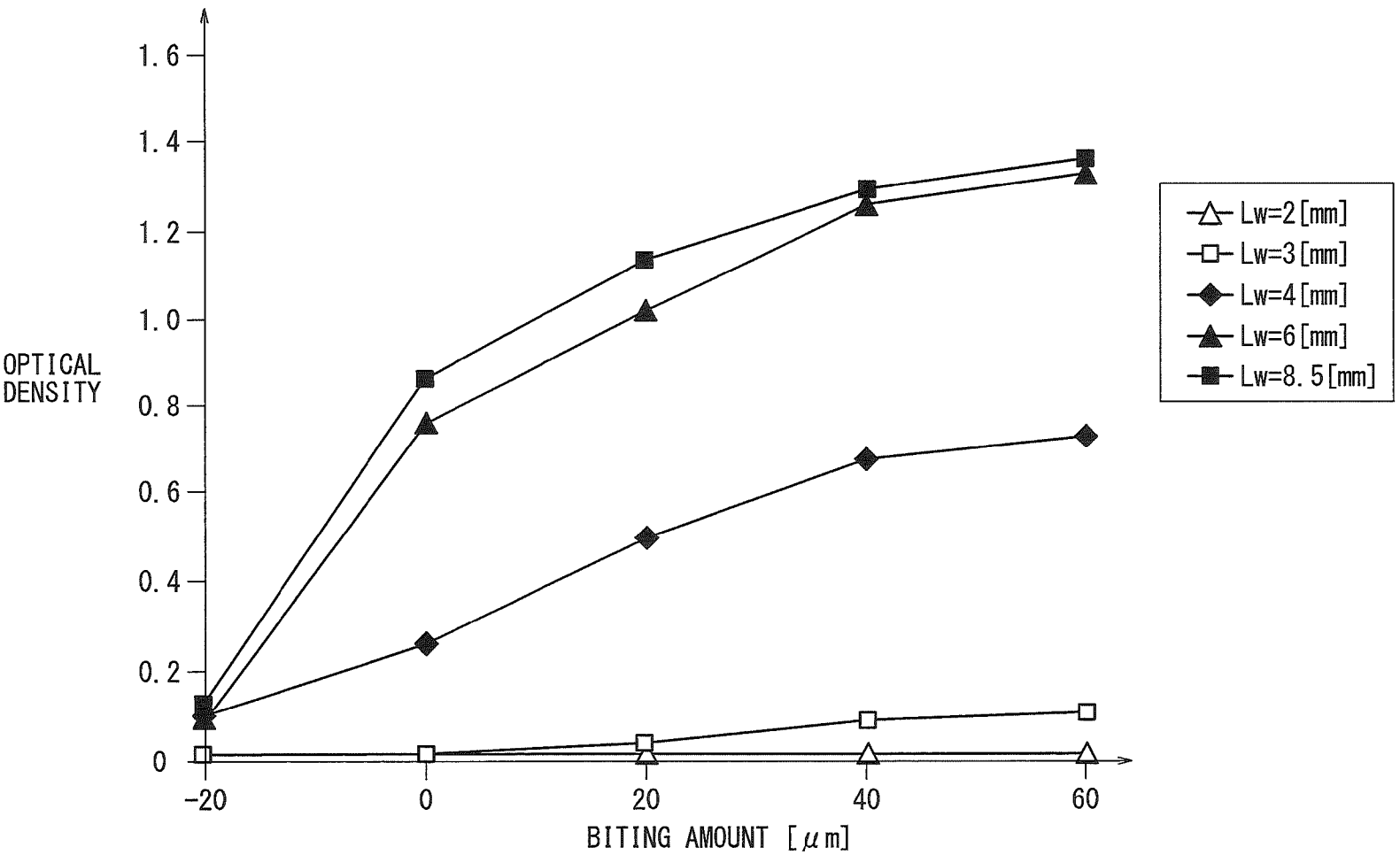
FIG. 15 is a graph showing relationships between optical density and a biting amount corresponding to a printing pressure.

FIG. 15 is a graph showing a relationship between optical density of the detecting portion images and a compression amount (biting amount) of the printing relief plate C2 produced by the printing pressure applied to the printing relief plate C2, wherein relationships are plotted for each width Lw (i.e., the width Lwa of the detecting portion 74*a* and the width Lwb of the detecting portion 74*b*). More specifically, the biting amount of the impression cylinder 30 or the anilox roller 28 with respect to the printing relief plate C2 changes depending on the magnitude of the printing pressure applied to the printing relief plate C2, and therefore, in the graph of FIG. 15, a relationship is shown between optical density and the biting amount, which corresponds to the magnitude of the printing pressure. Moreover, in FIG. 15, the biting amount is normalized such that a printing pressure corresponding to a condition where the biting amount is 0 [μm] is regarded as an appropriate printing pressure, and the optical density is normalized such that the optical density corresponding to a condition in which ink is not applied, i.e., does not become attached, to the print medium 32 is regarded as 0.

On the horizontal axis, which indicates the biting amount, a value of 0 [μm] indicates a condition in which the anilox roller 28 contacts the printing relief plate C2, and a gap becomes 0 between the printing relief plate C2 and the anilox roller 28, or a condition in which the impression cylinder 30 contacts the printing relief plate C2 through the print medium 32, and a gap becomes 0 between the print medium 32 and the printing relief plate C2.

Further, values in the positive direction of the horizontal axis indicate biting amounts at times that the printing relief plate C2 is compressed toward the plate cylinder 24, as a result of the impression cylinder 30 or the anilox roller 28 being pressed against the printing relief plate C2 to bite into the printing relief plate C2.

Furthermore, values in the negative direction of the horizontal axis are expansion values at times that the printing relief plate C2, which is released from a compressed state, expands radially outward from the plate cylinder 24, by the impression cylinder 30 or the anilox roller 28 separating away from the printing relief plate C2.

As shown in FIG. 15, in the case that a comparison is made at the same width Lw, as the biting amount corresponding to the printing pressure becomes greater, the optical density becomes higher. Accordingly, as the printing pressure becomes higher, the optical density of the detecting portion images approaches the optical density of the solid area image. Further, in the case that a comparison is made at the same biting amount, as the width Lw becomes wider, the optical density of the detecting portion images becomes higher, and approaches the optical density of the solid area image.

On the other hand, if the printing pressure applied to the plate surface of the printing relief plate C2 is an excessive printing pressure (over-printing pressure) equal to or greater than the printing pressure threshold, in addition to the ink attached to the solid area 72, among the inks 84*a*, 84*b* accommodated in the respective detecting portions 74*a*, 74*b*, at least the ink 84*b* accommodated in the detecting portion 74*b* is transferred securely to the print medium 32. As a result, the detecting portion image corresponding to the detecting portion 74*b* is of an optical density which is roughly equivalent to the optical density of the solid area image, and is printed as a detecting portion image corresponding to the flat surface shape of the detecting portion 74*b* on the print medium 32.

Accordingly, the optical densities of the respective detecting portion images corresponding to the two types of detecting portions 74*a*, 74*b* are compared with the optical density of the solid area image, and if the optical density of at least one of the types of the detecting portion images reaches the optical density of the solid area image, it can be determined easily and reliably that the printing pressure applied to the plate surface of the printing relief plate C2 is an excessive printing pressure.

Further, as shown in FIG. 15, as the width Lw grows wider, the optical density of the detecting portion images becomes higher, and therefore, in the case of a biting amount corresponding to an over-printing pressure, there is a possibility that the optical densities of the detecting portion images corresponding to the detecting portions 74*b* having comparatively wide widths Lwb will reach the optical density of the solid area image before the optical densities of the detecting portion images corresponding to the detecting portions 74*a* reaches the optical density of the solid area image. Thus, by paying attention to the optical densities of the detecting portion images corresponding to the detecting portions 74*b*, and comparing the optical densities thereof with the optical density of the solid area image, it can easily be determined whether the printing pressure applied to the plate surface of the printing relief plate C2 is either an appropriate printing pressure or an excessive printing pressure.

Furthermore, as shown in FIG. 15, concerning the two characteristics (referred to hereinbelow as a first characteristic) for which the width Lw is 6 [mm] and 8.5 [mm], the characteristic difference in the optical density change thereof is comparatively small. On the other hand, concerning the two characteristics (hereinafter referred to as a second characteristic) for which the width Lw is 2 [mm] and 3 [mm], the characteristic difference in the optical density change with respect to the difference in the width Lw also is comparatively small. More specifically, in the case that the width Lw exceeds 6 [mm], or in the case that the width Lw is equal to or less than 3 [mm], the optical density change due to the difference in the width Lw is small. Further, between the first characteristic and the second characteristic, the optical density difference is relatively large, and the change (slope) in optical density with respect to the biting amount tends to differ significantly.

Thus, according to the second embodiment, in the case that ink from the detecting portions corresponding to the first characteristic, and ink from the detecting portions corresponding to the second characteristic are transferred respectively to the print medium 32, it is possible to determine whether the printing pressure applied to the printing relief plate C2 is either an appropriate printing pressure or an excessive printing pressure, based on the relative difference in optical density (i.e., an optical density difference at a biting amount in the positive direction in excess of 0 [μm]) between the first characteristic and the second characteristic.

More specifically, if the optical density of the detecting portion image corresponding to the first characteristic reaches the optical density of the solid area image, it can be determined that the printing pressure applied to the plate surface of the printing relief plate C2 has become an excessive printing pressure in excess of the printing pressure threshold. Thus, in the case that an optical density difference between the optical density of the first characteristic at the biting amount corresponding to the printing pressure threshold and the optical density of the second characteristic at the aforementioned biting amount is defined as an optical density difference (density difference threshold) corresponding to the printing pressure threshold, then if the relative optical density difference between the first characteristic and the second characteristic as actually obtained is less than the density difference threshold, it can be determined that the printing pressure applied to the plate surface of the printing relief plate C2 is an appropriate printing pressure, whereas if the relative optical density difference exceeds the density difference threshold, it can be determined that the printing pressure is an excessive printing pressure.

Further, plural detecting portion units 73 are formed in the solid area 72, each of the detecting portion units 73 being constituted from two detecting portions 74*a*, 74*b*. Thus, among the detecting portion images corresponding to the detecting portions 74*a*, 74*b*, the number of detecting portion images that exhibit optical densities substantially equivalent to the optical density of the solid area image (i.e., the number of detecting portion images which are determined as having been printed at an excessive printing pressure), and the number of detecting portion images that exhibit optical densities lower than the optical density of the solid area image (i.e., the number of detecting portion images which are determined as having been printed at an appropriate printing pressure) are counted, and by means of a majority decision, i.e., if (the number of detecting portion images which are determined as having been printed at an excessive printing pressure)>(the number of detecting portion images which are determined as having been printed at an appropriate printing pressure), it may be determined that the printed pressure applied to the plate surface of the printing relief plate C2 is an excessive printing pressure.

In this case, for example, a majority decision may be carried out only in regard to detecting portion images corresponding to the detecting portions 74*a* or the detecting portions 74*b*, or a majority decision may be carried out in regard to detecting portion images corresponding to all of the detecting portions 74*a*, 74*b*.

[Description of Printing Pressure Determining Method According to the Second Embodiment]

The printing relief plate C2 according to the second embodiment is constructed basically as described above. Next, a method for determining whether the printing pressure applied to the printing relief plate C2 is either an appropriate printing pressure or an excessive printing pressure (operations, i.e., a printing pressure determining method, of the printing pressure determining apparatus 39B according to the second embodiment), based on the solid area image and the detecting portion images that are printed on a print P2 using the printing relief plate C2, will be described with reference to FIGS. 8 and 9. In the following descriptions, as necessary, reference will also be made to features shown in FIGS. 1 to 3 and FIGS. 10 to 15.

For facilitating explanation, at first, a case will be described in which a judgment of an appropriate printing pressure or an excessive printing pressure is carried out, based on a comparison between the solid area image and detecting portion images corresponding to the two detecting portions 74*a*, 74*b* that constitute an individual detecting portion unit 73. Next, a case will be described in which a judgment of an appropriate printing pressure or an excessive printing pressure is carried out by making respective comparisons between the solid area image and respective detecting portion images corresponding to respective detecting portions 74*a*, 74*b* of a plurality of detecting portion units 73, and then, by means of a majority decision concerning the judgment results, it is determined whether the printing pressure of the printing relief plate C2 is either an appropriate printing pressure or an excessive printing pressure.

In step S1 of FIG. 8, the image capturing device 34 (see FIG. 2) captures various images including a solid area image and detecting portion images printed on the print P2, and outputs image signals representative of the captured images to the judgment processor 36.

In step S2, the judgment processor 36 detects respective optical densities of a solid area image and the detecting portion images indicated by the input image signals.

In step S3, the judgment processor 36 refers to the table shown in FIG. 9, which is stored beforehand in the memory 38, the table indicating a relationship between the optical density Nc and the printing pressure Pc applied to the printing relief plate C2, and identifies the printing pressure Pc from the optical density Nc of the detecting portion image.

The optical density of the solid area image is a substantially 100% optical density, irrespective of differences in the appropriate printing pressure or the over-printing pressure, and is an optical density equal to or greater than a density threshold Nth. Owing thereto, the judgment processor 36 can identify the printing pressure Pc from the optical density Nc in relation only to the detecting portion image. As shown in FIG. 15, since graphs indicating the relationship between printing pressure and optical density are obtained for each width Lw, in actuality, in the table shown in FIG. 9 as well, respective curves (graphs), which indicate a relationship between printing pressure and optical density, are provided for each width Lw (Lwa, Lwb).

In step S4, the judgment processor 36 determines whether or not the printing pressure Pc has reached the predetermined print pressure threshold Pth (a printing pressure corresponding to the density threshold Nth, which corresponds to the optical density of the solid area image). In the case that the inequality Pc≥Pth is satisfied (step S4: YES), the judgment processor 36 determines that the printing pressure Pc is an excessive printing pressure, and externally notifies a judgment result (warning) indicative of the over-printing pressure (step S5). On the other hand, if the inequality Pc<Pth is satisfied (step S4: NO), the judgment processor 36 determines that the printing pressure Pc is an appropriate printing pressure, and externally notifies a judgment result indicative of the appropriate printing pressure (step S6).

More specifically, if the printing pressure Pc is an appropriate printing pressure less than the printing pressure threshold Pth, the inks 84*a*, 84*b* accommodated in the detecting portions 74*a*, 74*b* are transferred to the print medium 32 in a lightly touching manner, and the optical densities of the detecting portion images formed by the transferred ink 84*a*, 84*b* are sufficiently lower than the optical density (an optical density equal to or greater than the optical density threshold Nth) of the solid area image. On the other hand, if the printing pressure Pc is an excessive printing pressure equal to or greater than the printing pressure threshold Pth, among the inks 84*a*, 84*b* accommodated in the detecting portions 74*a*, 74*b*, at least one ink 84*b* is transferred securely to the print medium 32, and the optical density Nc of the detecting portion image formed by the transferred ink 84*b* becomes an optical density (an optical density equal to or greater than the optical density threshold Nth) which is substantially equivalent to the optical density of the solid area image.

Accordingly, by comparing the printing pressure Pc corresponding to the optical density Nc of the detecting portion image, which is printed by the securely transferred ink 84*b*, with the printing pressure threshold Pth that corresponds to the density threshold Nth, which is the minimum value of the optical density of the solid area image, the printing pressure Pc can easily and reliably be judged as being either an appropriate printing pressure or an excessive printing pressure, and the judgment result can be notified (i.e., output) to the exterior.

Moreover, as described above, since the optical density corresponding to the printing pressure threshold Pth is the density threshold Nth, in step S4, the judgment processor 36 may determine whether the printing pressure Pc is either an appropriate printing pressure or an excessive printing pressure, based on a comparison between the optical density Nc and the density threshold Nth.

In the above description, an explanation has been given concerning a judgment process of an appropriate printing pressure or an over-printing pressure, based on a comparison between a solid area image corresponding to the solid area 72 and detecting portion images corresponding to two detecting portions 74*a*, 74*b* of one detecting portion unit 73.

Next, a description shall be given concerning a case of performing a judgment process of an appropriate printing pressure or an over-printing pressure, based on comparisons between a solid image area and each of detecting portion images corresponding to detecting portions 74*a*, 74*b* of a plurality of detecting portion units 73.

In step S1, the image capturing device 34 captures various images including a solid area image and a plurality of detecting portion images printed on the print P2, and outputs image signals representative of the captured images to the judgment processor 36.

In step S2, the judgment processor 36 detects respective optical densities of the solid area image and each of the detecting portion images indicated by the input image signals.

In step S3, the judgment processor 36 refers to the table shown in FIG. 15, which is stored beforehand in the memory 38, and identifies printing pressures Pc respectively from the optical densities Nc of the plural detecting portion images.

In step S4, the judgment processor 36 compares one printing pressure Pc among the identified plural printing pressures Pc with the printing pressure threshold Pth. In this case, even if the inequality Pc≥Pth is satisfied (step S4: YES), or even if the inequality Pc<Pth is satisfied (step S4: NO), the judgment processor 36 implements the process of the following step S7.

In the following step S7, if the judgment process of step S4 has not been completed with respect to the plural printing pressures Pc corresponding to all of the detecting portion images (step S7: NO), the judgment processor 36 returns to step S4, and the judgment process is implemented on any printing pressures Pc for which the judgment process has not yet been implemented.

On the other hand, if the judgment process has been completed with respect to all of the plural printing pressures Pc (step S7: YES), then in step S8, the judgment processor 36 determines, with respect to all of the printing pressures Pc, whether or not the number of printing pressures Pc judged to be excessive pressures represents a majority.

If the number of printing pressures Pc judged to be excessive printing pressures is in the majority, the judgment processor 36 determines that the printing pressure of the printing relief plate C2 is an excessive printing pressure (step S8: YES), and the process of step S5 is carried out. On the other hand, if the number of printing pressures Pc judged to be excessive printing pressures does not reach a majority (in other words, if the number of printing pressures Pc judged to be appropriate printing pressures is in the majority), the judgment processor 36 determines that the printing pressure of the printing relief plate C2 is an appropriate printing pressure (step S8: NO), and the process of step S6 is carried out.

In step S2, the judgment processor 36 may detect an optical density of only one detecting portion image from among the plural detecting portions represented by the input image signals. In this case, if the judgment process with respect to all of the detecting portion images is not completed at step S7, step S2 is returned to, and the processes of steps S2 through S4 are carried out again.

Further, in step S3, the judgment processor 36 may identify a printing pressure Pc in relation to an optical density Nc of one detecting portion image from among the optical densities of the plural detecting portion images. In this case, if the judgment process with respect to all of the detecting portion images is not completed at step S7, step S3 is returned to, and the processes of steps S3 and S4 are carried out again.

[Effects of the Second Embodiment]

As has been described above, according to the second embodiment, in the printing relief plate C2, the plural detecting portions 74*a*, 74*b* are set to be higher than the lowest convexity 76*c*, or are set to substantially the same height as the lowest convexity 76*c*. Therefore, for example, even if the anilox pressure is set at a minimum pressure in compliance with the printing conditions of the print medium 32, inks 84*a*, 84*b* can be supplied to the detecting portions 74*a*, 74*b* and the convexity 76*c*, and the inks 84*a*, 84*b* attached to the detecting portions 74*a*, 74*b* can be transferred reliably to the print medium 32, whereby respective detecting portion images can be printed.

Further, in the case where the widths Lwa, Lwb of the respective detecting portions 74*a*, 74*b* differ mutually from each other, even if the same printing pressure is applied to the respective detecting portions 74*a*, 74*b*, the adhesion of inks 84*a*, 84*b*, which are transferred from each of the detecting portions 74*a*, 74*b* to the print medium 32, differ from one another, and thus the widths of the respective detecting portion images corresponding to the detecting portions 74*a*, 74*b* also differ mutually from each other. More specifically, as the widths Lwa, Lwb of the detecting portions 74*a*, 74*b* grow wider, it becomes easier for the inks 84*a*, 84*b* to be transferred to the print medium 32, and the optical density of the detecting portion images corresponding to the concerned detecting portions 74*a*, 74*b* approaches more closely to the optical density of the solid area image.

Thus, according to the second embodiment, by comparing the optical density of the solid area image with the optical densities of the detecting portion images, which differ in width from each other, irrespective of the magnitude of the anilox pressure, it can be judged easily whether the printing pressure Pc is either an appropriate printing pressure or an over-printing pressure.

Further, on the plate surface of the printing relief plate C2, the solid area 72 is a flat portion having an area equal to or greater than a certain fixed area, and which is positioned higher than other portions making up the printing relief plate C1. For this reason, in the case that the printing pressure Pc is an appropriate printing pressure, the plate surface of the printing relief plate C2 is in a kiss-touch state with respect to the print medium 32, whereby ink is transferred securely to the print medium 32 from the solid area 72, together with the inks 84*a*, 84*b* being transferred to the print medium 32 from the detecting portion 74*a*, 74*b* in a lightly touching manner. In this case, the optical density of the solid area image is substantially 100%, whereas the density Nc of the detecting portion images is a low optical density compared to the solid area image, even though the widths Lwa, Lwb of the respective detecting portions 74*a*, 74*b* differ mutually from each other.

On the other hand, as the widths Lwa, Lwb of the detecting portions 74*a*, 74*b* grow wider, the inks 84*a*, 84*b* are transferred more easily to the print medium 32. Thus, in the case that the printing pressure Pc is an excessive printing pressure, ink 84*b* from at least one of the detecting portions 74*b* is transferred securely to the print medium 32, and the optical density Nc of the detecting portion image corresponding to the concerned detecting portion 74*b* becomes substantially equivalent to the optical density of the solid area image.

Thus, according to the second embodiment, as described above, by comparing the optical density Nc of each of the detecting portion images with the optical density (optical density threshold Nth) of the solid area image, it can be judged easily whether or not the printing pressure Pc is an excessive printing pressure.

More specifically, as the widths Lwa, Lwb of the detecting portions 74*a*, 74*b* grow wider, it becomes easier for the inks 84*a*, 84*b* to be transferred to the print medium 32. Thus, among the detecting portion images, if the optical density Nc of the detecting portion image corresponding to the detecting portion 74*b* having a comparatively wide width Lwb reaches the density (density threshold Nth) of the solid area image, it can be determined easily and reliably that the printing pressure Pc is an excessive printing pressure (i.e., has reached the printing pressure threshold Pth).

Moreover, due to the difference in widths, the attachment of the inks 84*a*, 84*b*, which are transferred to the print medium 32 from the detecting portions 74*a*, 74*b*, differ mutually from each other, and therefore, it may also be judged whether the printing pressure Pc is an appropriate printing pressure or an excessive printing pressure, based on a relative optical density difference between respective detecting portion images corresponding to the detecting portions 74*a*, 74*b* of different widths Lwa, Lwb (for example, two detecting portions including a detecting portion having a comparatively wide width and a detecting portion having a comparatively narrow width).

Furthermore, the detecting portions 74*a*, 74*b* are recesses formed in the solid area 72, wherein the height position of the bottom surfaces 82*a*, 82*b* of the recesses is higher than the height position of the apex 78*c* of the convexity 76*c*, or is substantially the same as the height position of the apex 78*c* of the convexity 76*c*. Therefore, inks 84*a*, 84*b* supplied from the anilox roller 28 are accommodated in the recesses, and the inks 84*a*, 84*b* accommodated therein can be transferred reliably to the print medium 32.

Further, if at least the apex 78*c* of the convexity 76*c* is formed as a flat portion, the image quality of the halftone dot image formed by ink that is transferred to the print medium 32 from the convexity 76*c* can be improved.

Furthermore, cases may occur in which a height variance (height distribution) exists to some degree over the entirety of the printing relief plate C2. Thus, a plurality of individual detecting portion units 73, each of which is constituted from two detecting portions 74*a*, 74*b*, may be provided, and by a majority decision based on the comparison result between the optical density of the solid area image and optical densities Nc of the detecting portion images corresponding to the respective detecting portions 74*a*, 74*b*, it can be determined whether the printing pressure Pc is an appropriate printing pressure or an excessive printing pressure. In this manner, the influence of any height variance of the detecting portions 74*a*, 74*b* on the judgment result of the printing pressure Pc can be suppressed, and a determination can be carried out reliably and more accurately as to whether the printing pressure is an appropriate printing pressure or an excessive printing pressure.

In addition, since the aforementioned printing relief plate producing apparatus 10B, the printing relief plate producing method, the flexographic printing press 20B, the printing method, the printing pressure determining apparatus 39B, and the printing pressure determining method are a method or apparatus related to the aforementioned printing relief plate C2, the same advantages and effects of the printing relief plate C2 can be achieved.

Furthermore, similar to the first embodiment, in the second embodiment, an operator, through visual confirmation, and by comparing the optical density of the solid area image with the optical densities Nc of the detecting portion images, can make a judgment as to whether the printing pressure Pc is either an appropriate printing pressure or an excessive printing pressure.

Although certain preferred embodiments of the present invention have been shown and described in detail, it should be understood that various changes and modifications may be made to the embodiments without departing from the scope of the invention as set forth in the appended claims.

What is claimed is:

1. A printing relief plate having convexities formed on a surface of a plate material, the convexities being adapted to print halftone dots on a print medium by transferring ink to the print medium, on the surface of the plate material, the printing relief plate comprising:

a solid area;

an image forming region in which the convexities are formed in plurality; and at least one detecting portion is used for determining a magnitude of a printing pressure applied to the printing relief plate in a case where ink is transferred to the print medium from the printing relief plate; the convexities and the detecting portion are positioned lower than the solid area; and the at least one detecting portion is used for determining whether the printing pressure is an appropriate printing pressure by comparing a density of at least one detecting portion image, which is printed on the print medium by transferring ink to the print medium from the detecting portion, with a density of a solid area image, which is printed on the print medium by transferring ink to the print medium from the solid area, wherein the detecting portion is a recess formed in the solid area, and wherein a height position of a bottom surface of the recess is substantially the same as a height position of an apex of a lowest highlight convexity.

2. The printing relief plate according to claim 1, wherein the detecting portion and the lowest highlight convexity among the convexities are set at substantially the same height.

3. The printing relief plate according to claim 2, wherein the at least one detecting portion is used for determining that the printing pressure is an appropriate printing pressure if the density of the detecting portion image is lower than the density of the solid area image, and wherein the at least one detecting portion is used for determining that the printing pressure is an excessive printing pressure if the density of the detecting portion image is substantially equivalent to the density of the solid area image.

4. The relief plate according to claim 2, wherein the detecting portion is disposed at the same height position as the highlight convexity, or is disposed at a slightly higher height position than the highlight convexity.

5. The relief plate according to claim 2, wherein the convexities are set at the same height position as the highlight convexity.

6. The printing relief plate according to claim 2, wherein: a plurality of the detecting portions are formed on the surface of the plate material; a plurality of the detecting portion images are printed on the print medium by transferring ink to the print medium from each of the detecting portions; and the plurality of detecting portions is used for determining whether the printing pressure is an appropriate printing pressure or an excessive printing pressure, by comparing a density of the solid area image and a density of each of the detecting portion images and then making a majority decision between a number of detecting portion images corresponding to the appropriate printing pressure and a number of detecting portion images corresponding to the excessive printing pressure.

7. The printing relief plate according to claim 1, wherein at least the apex of the highlight convexity comprises a flat portion.

8. The printing relief plate according to claim 1, wherein: on the surface of the plate material, there are provided the solid area, the image forming region, and a plurality of the detecting portions; the detecting portions are of mutually different widths, and are positioned higher than a lowest highlight convexity among the convexities, or are of the same height as the highlight convexity; and the plurality of detecting portions are used for determining whether the printing pressure is an appropriate printing pressure by comparing densities of a plurality of the detecting portion images, which are printed on the print medium by transferring ink to the print medium from the detecting portions, with a density of the solid area image.

9. The printing relief plate according to claim 8, wherein the at least one detecting portion is used for determining that the printing pressure is an appropriate printing pressure if the densities of the detecting portion images are lower than the density of the solid area image, even if ink is transferred to the print medium from the detecting portions, whereas among the detecting portion images the at least one detecting portion is used for determining that the printing pressure is an excessive printing pressure, if there is at least one detecting portion image that has substantially the same density as the density of the solid area image.

10. The printing relief plate according to claim 9, wherein among the detecting portion images, the at least one detecting portion is used for determining that the printing pressure is an excessive printing pressure if a density of a detecting portion image corresponding to a detecting portion having a comparatively wide width is substantially equal to the density of the solid area image.

11. The printing relief plate according to claim 8, wherein the at least one detecting portion is used for determining that the printing pressure is an appropriate printing pressure based on a density difference between two of the detecting portion images that correspond to at least two detecting portions of mutually different widths.

12. The printing relief plate according to claim 8, wherein: in the case that at least two of the detecting portions of different widths are regarded as one detecting portion unit, a plurality of the detecting portion units are formed on the surface of the plate material; the detecting portion images are printed on the print medium by transferring ink to the print medium from each of the detecting portions of the detecting portion units; and the plurality of detecting portions is used for determining whether the printing pressure is an appropriate printing pressure or an excessive printing pressure, by comparing a density of the solid area image with a density of each of the detecting portion images and then making a majority decision between a number of detecting portion images corresponding to the appropriate printing pressure and a number of detecting portion images corresponding to the excessive printing pressure.

13. A printing relief plate producing apparatus for producing a printing relief plate having convexities formed on a surface of a plate material, the convexities being adapted to print halftone dots on a print medium by transferring ink to the print medium, wherein on the surface of the plate material, there are provided a solid area, an image forming region in which the convexities are formed in plurality, and at least one detecting portion which is used for determining a magnitude of a printing pressure applied to the printing relief plate in a case where ink is transferred to the print medium from the printing relief plate; the printing relief plate producing apparatus comprising: a binary image data generator for generating binary image data based on multi-valued image data representative of a printed image; a plate shape determining unit for generating shape data based on the binary image data, the shape data representing shapes of the solid area, the image forming region including the convexities, and the detecting portion; and a printing relief plate producing unit for producing the printing relief plate based on the shape data, and further wherein: the convexities and the detecting portion are positioned lower than the solid area; the at least one detecting portion is used for determining whether the printing pressure is an appropriate printing pressure by comparing a density of at least one detecting portion image, which is printed on the print medium by transferring ink to the print medium from the detecting portion, with a density of a solid area image, which is printed on the print medium by transferring ink to the print medium from the solid areas the detecting portion is a recess formed in the solid area; and a height position of a bottom surface of the recess is substantially the same as a height position of an apex of a lowest highlight convexity.

14. A printing relief plate producing method for producing a printing relief plate having convexities formed on a surface of a plate material, the convexities being adapted to print halftone dots on a print medium by transferring ink to the print medium, wherein on the surface of the plate material, there are provided a solid area, an image forming region in which the convexities are formed in plurality, and at least one detecting portion which is used for determining a magnitude of a printing pressure applied to the printing relief plate in a case where ink is transferred to the print medium from the printing relief plate, the printing relief plate producing method comprising: generating binary image data based on multi-valued image data representative of a printed image; generating shape data based on the binary image data, the shape data representing shapes of the solid area, the image forming region including the convexities, and the detecting portion; and producing the printing relief plate based on the shape data, and further wherein: the convexities and the detecting portion are positioned lower than the solid area; the at least one detecting portion is used for determining whether the printing pressure is an appropriate printing pressure by comparing a density of a detecting portion image, which is printed on the print medium by transferring ink to the print medium from the detecting portion, with a density of a solid area image, which is printed on the print medium by transferring ink to the print medium from the solid area, the detecting portion is a recess formed in the solid area; and a height position of a bottom surface of the recess is substantially the same as a height position of an apex of a lowest highlight convexity.

15. A printing apparatus for printing halftone dots on a print medium by transferring ink to the print medium from convexities provided on a surface of a plate material of a printing relief plate, the printing apparatus comprising: an anilox roller; a plate cylinder on which the printing relief plate is mounted, ink being transferred to the printing relief plate from the anilox roller; and an impression cylinder, which sandwiches the print medium in cooperation with the plate cylinder on which the printing relief plate is mounted, whereby ink is transferred to the print medium from the convexities, and then the halftone dots are printed on the print medium, wherein: on the surface of the plate material, there are provided a solid area, an image forming region in which the convexities are formed in plurality, and at least one detecting portion which is used for determining a magnitude of a printing pressure applied to the printing relief plate in a case where ink is transferred to the print medium from the printing relief plate; the convexities and the detecting portion are positioned lower than the solid area; the at least one detecting portion is used for determining whether the printing pressure is an appropriate printing pressure by comparing a density of at least one detecting portion image, which is printed on the print medium by transferring ink to the print medium from the detecting portion, with a density of a solid area image, which is printed on the print medium by transferring ink to the print medium from the solid area, the detecting portion is a recess formed in the solid area; and a height position of a bottom surface of the recess is substantially the same as a height position of an apex of a lowest highlight convexity.

16. A printing method for printing halftone dots on a print medium by transferring ink to the print medium from convexities provided on a surface of a plate material of a printing relief plate, comprising:

transferring ink from the anilox roller to the printing relief plate, which is mounted on a plate cylinder; and printing the halftone dots on the print medium by transferring ink to the print medium from the convexities, under a condition in which the print medium is sandwiched between an impression cylinder and the plate cylinder on which the printing relief plate is mounted, wherein:

on the surface of the plate material, there are provided a solid area, an image forming region in which the convexities are formed in plurality, and at least one detecting portion for determining a magnitude of a printing pressure applied to the printing relief plate in a case where ink is transferred to the print medium from the printing relief plate;

the detecting portion is a recess formed in the solid area; and a height position of a bottom surface of the recess is substantially the same as a height position of an apex of a lowest highlight convexity, the convexities and the detecting portion are positioned lower than the solid area and further comprising determining, using the at least one detecting portion, whether the printing pressure is an appropriate printing pressure by comparing a density of at least one detecting portion image, which is printed on the print medium by transferring ink to the print medium from the detecting portion, with a density of a solid area image, which is printed on the print medium by transferring ink to the print medium from the solid area.

17. A printing pressure determining apparatus for determining a magnitude of a printing pressure applied to a printing relief plate in a case where halftone dots are printed on a print medium by transferring ink to the print medium from convexities, which are provided on a surface of a plate material of the printing relief plate, wherein:

on the surface of the plate material, there are provided a solid area, an image forming region in which the convexities are formed in plurality, and at least one detecting portion for determining the magnitude of the printing pressure applied to the printing relief plate in a case where ink is transferred to the print medium from the printing relief plate;

the convexities and the detecting portion are positioned lower than the solid area;

the detecting portion is a recess formed in the solid area; and a height position of a bottom surface of the recess is substantially the same as a height position of an apex of a lowest highlight convexity, the printing pressure determining apparatus further comprising:

an image capturing device for capturing at least one detecting portion image which is printed on the print medium by transferring ink to the print medium from the detecting portion; and a judgment processor for determining whether the printing pressure is an appropriate printing pressure, based on a comparison between a density of the detecting portion image, which is captured by the image capturing device, and a density of a solid area image, which is printed on the print medium by transferring ink to the print medium from the solid area.

18. A printing pressure determining method for determining a magnitude of a printing pressure applied to a printing relief plate in a case where halftone dots are printed on a print medium by transferring ink to the print medium from convexities, which are provided on a surface of a plate material of the printing relief plate, wherein: on the surface of the plate material, there are provided a solid area, an image forming region in which the convexities are formed in plurality, and at least one detecting portion for determining the magnitude of the printing pressure applied to the printing relief plate in a case where ink is transferred to the print medium from the printing relief plate; and the convexities and the detecting portion are positioned lower than the solid area; the printing pressure determining method comprising:

capturing at least one detecting portion image which is printed on the print medium by transferring ink to the print medium from the detecting portion;

determining whether the printing pressure is an appropriate printing pressure, based on a comparison between a density of the captured detecting portion image, and a density of a solid area image, which is printed on the print medium by transferring ink to the print medium from the solid area, wherein the detecting portion is a recess formed in the solid area; and wherein a height position of a bottom surface of the recess is substantially the same as a height position of an apex of a lowest highlight convexity.

* * * * *